US012467323B2

(12) United States Patent
Al-Mousa et al.

(10) Patent No.: US 12,467,323 B2
(45) Date of Patent: Nov. 11, 2025

(54) OPENHOLE LOGGING TOOL INTEGRATING WELLBORE FLUIDS TREATMENT SYSTEM AND METHOD OF USE

(71) Applicant: SAUDI ARABIAN OIL COMPANY, Dhahran (SA)

(72) Inventors: Ahmed Abdulaziz Al-Mousa, Dhahran (SA); Linlin Wang, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/589,835

(22) Filed: Feb. 28, 2024

(65) Prior Publication Data

US 2025/0270886 A1 Aug. 28, 2025

(51) Int. Cl.

| | |
|---|---|
| ***E21B 21/01*** | (2006.01) |
| ***E21B 21/06*** | (2006.01) |
| ***E21B 23/00*** | (2006.01) |
| ***E21B 23/04*** | (2006.01) |

(52) U.S. Cl.

CPC ..... *E21B 21/019* (2020.05); *E21B 21/062* (2013.01); *E21B 23/004* (2013.01); *E21B 23/0411* (2020.05); *E21B 23/0415* (2020.05)

(58) Field of Classification Search

CPC .... E21B 21/019; E21B 21/062; E21B 23/004; E21B 23/0411; E21B 23/0415

See application file for complete search history.

(56) References Cited

U.S. PATENT DOCUMENTS

| | | | | |
|---|---|---|---|---|
| 5,398,754 | A | 3/1995 | Dinhoble | |
| 7,584,800 | B2 | 9/2009 | Heath et al. | |
| 8,443,915 | B2 * | 5/2013 | Storm, Jr. | E21B 10/62 175/57 |
| 9,518,434 | B1 * | 12/2016 | Champness | E21B 17/006 |
| 2008/0289818 | A1 | 11/2008 | Buck et al. | |
| 2010/0152068 | A1 | 6/2010 | Hartshorne et al. | |

* cited by examiner

*Primary Examiner* — Matthew R Buck

(74) *Attorney, Agent, or Firm* — Osha Bergman Watanabe & Burton LLP

(57) ABSTRACT

A method includes drilling a wellbore and deploying a logging string including a jet nozzle and an anchor in the wellbore. The method includes hydraulically coupling a jetting treatment system including a mud treatment system to a mud circulation system, hydraulically coupling a drilling mud including wellbore fluids to the mud circulation system, and hydraulically coupling the mud circulation system to a drill string bore of the drill string. The method includes activating the jetting treatment system to circulate the drilling mud in the mud treatment system. The method includes circulating in the wellbore, using the jetting treatment system, a treatment mud, disposed in the mud treatment system, wherein the treatment mud is configured for treating the wellbore fluids. The method includes logging the well using the logging string, and treating the wellbore fluids using the treatment mud to form treated wellbore fluids.

20 Claims, 14 Drawing Sheets

OPENHOLE LOGGING TOOL INTEGRATING WELLBORE FLUIDS TREATMENT SYSTEM AND METHOD OF USE

BACKGROUND

In the oil and gas industry wells, hydrocarbons are located in reservoirs far beneath the surface of the Earth. Wells are drilled into subsurface reservoirs to access and produce the hydrocarbons. As a wellbore is created beneath the surface of the Earth, openhole logging tools may be run into the wellbore in order to identify formation data from the hydrocarbon reservoir zone. Rock core samples are often extracted and brought to the surface for examination and analysis. A reservoir characteristic may incorporate any of the characteristics pertinent to the ability of the reservoir to store and produce hydrocarbons.

Information about the subsurface, often represented in the form of digital models, is used to evaluate the reservoir. Information is combined from many sources: remote sensing e.g., seismic and gravity; direct sampling, e.g., core samples from current and previous wells; and proximate measurements, e.g., well logs. A recurrent problem of current openhole logging systems are that they are required to be run with wireline conveys to the desired depth, which means that there is no way for circulating the wellbore fluids for treatment during logging operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, a method including drilling a wellbore of a well in a formation using a drill string of a drilling system in hydraulic communication with the formation. The method includes deploying a logging string including a jet nozzle and an anchor to a determined depth in the wellbore. The method includes hydraulically coupling a jetting treatment system including a mud treatment system to a mud circulation system, hydraulically coupling a drilling mud including wellbore fluids to the mud circulation system, and hydraulically coupling the mud circulation system to a drill string bore of the drill string. The method includes activating the mud circulation system to circulate the drilling mud in the wellbore; and activating the jetting treatment system to circulate the drilling mud in the mud treatment system. The method includes circulating in the wellbore, using the jetting treatment system, a treatment mud, disposed in the mud treatment system, wherein the treatment mud is configured for treating the wellbore fluids. The method includes logging the well using the logging string, and treating the wellbore fluids using the treatment mud to form treated wellbore fluids. The method includes deactivating the mud circulation system to stop circulating the drilling mud in the wellbore, deactivating the jetting treatment system to stop circulating the drilling mud in the mud treatment system, and retrieving the logging string from the wellbore.

This disclosure presents, in accordance with one or more embodiments, a system including a drill string of a drilling system in hydraulic communication with a formation configured for drilling a wellbore of a well in the formation. The system includes a logging string including a jet nozzle and an anchor configured for deploying to a determined depth in the wellbore. The system includes a jetting treatment system including a mud treatment system configured for hydraulically coupling to a mud circulation system, and a drilling mud including wellbore fluids configured for hydraulically coupling to the mud circulation system. The mud circulation system is configured for hydraulically coupling to a drill string bore of the drill string. The mud circulation system, when activated, is configured to circulate the drilling mud in the wellbore. The jetting treatment system, when activated, is configured to circulate the drilling mud in the mud treatment system. The system includes a treatment mud disposed in the mud treatment system. The mud treatment system is configured for treating the wellbore fluids, and circulating, using the jetting treatment system, in the wellbore. The logging string is configured for logging the well. The treated wellbore fluids are formed from treating the wellbore fluids using the treatment mud. The mud circulation system, when deactivated, is configured to stop circulating the drilling mud in the wellbore. The jetting treatment system, when deactivated, is configured to stop circulating the drilling mud in the mud treatment system, and the logging string is configured to be retrieved from the wellbore.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
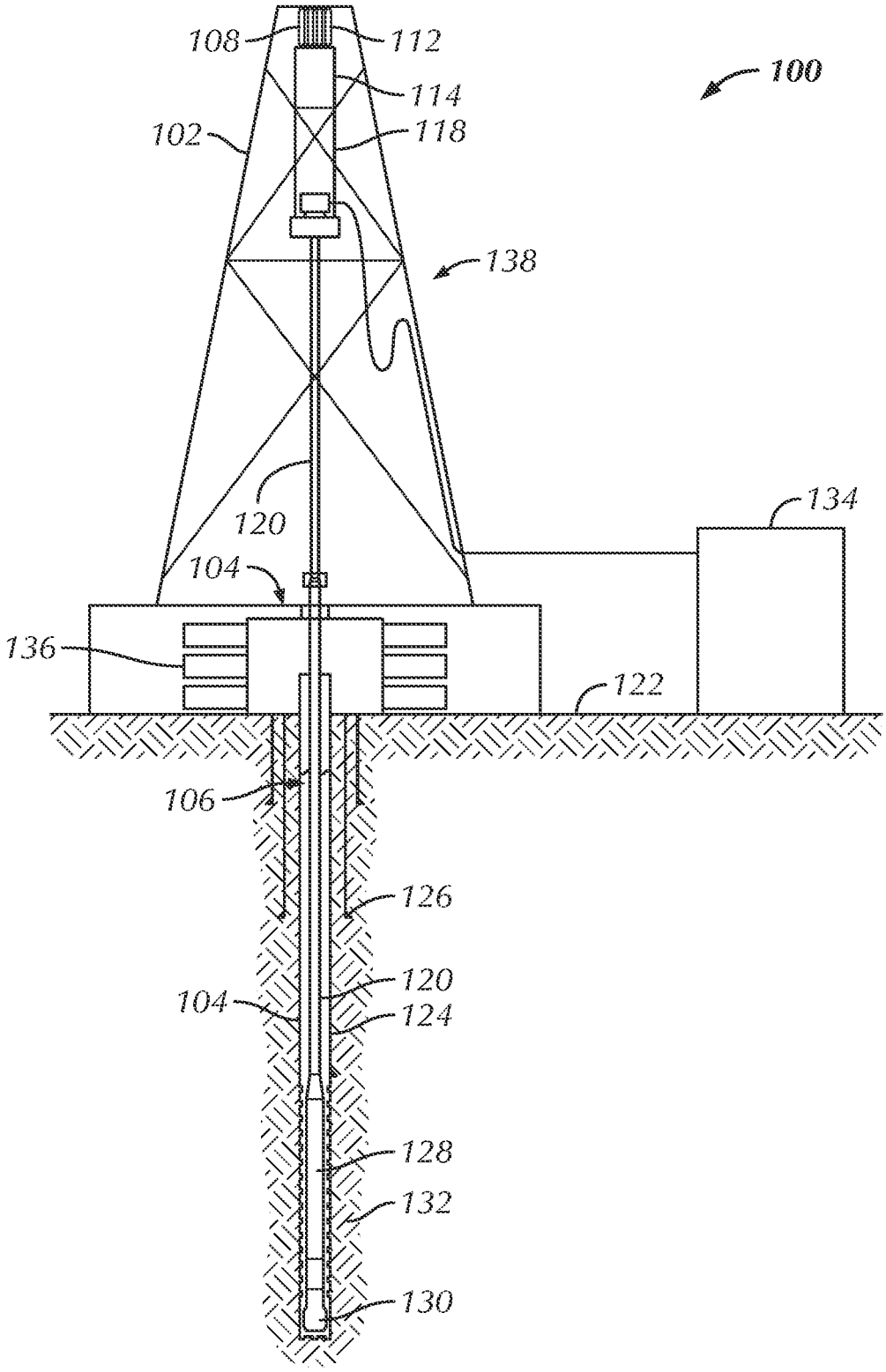
FIG. 1 illustrates an example wellsite in accordance with one or more embodiments.

In the following detailed description of embodiments of the disclosure numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and may succeed or precede the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

Embodiments disclosed herein relate to a system and method for logging an openhole wellbore while treating wellbore fluids. The disclosed system and method may allow the logging tools to treat the wellbore fluids by themselves without having to use the rig mud pumps for circulating the wellbore fluids through drill stings, thereby avoiding additional wellbore condition trips, and commensurately saving rig time and cost. Several operations while completing and working over wells require running openhole logging tools in order to identify formation data from the hydrocarbon reservoir zone. One of the main limitations of current openhole logging systems is that they require to be run with wireline to the desired depth, which means that there is no way for circulating the wellbore fluids for treatment during logging operations. In accordance with one or more embodiments the logging tools perform the logging while continuously treating the wellbore fluids. The disclosed may prevent solids in the wellbore fluids from settling down or gelling up in situations where the logging tool is stationary. The disclosed may avoid differential sticking and/or may avoid having the wellbore in an underbalanced condition. In addition, the disclosed may help rig crew personnel minimize the pipe handling operations for wellbore fluids condition trips, thereby avoiding injuries. The disclosed system may be known by various names, such as an openhole logging-treating system (e.g., OHL-TS). In one or more embodiments, the downhole tool/device is referred to herein as a jet anchor system.

Prior systems require to be run with wireline conveys to the desired depth, which means that there is no way for circulating the wellbore fluids for treatment during logging operations. The disclosed may allow treating and shearing the wellbore fluids while formation logging. The logging systems used in current practice are not designed with the capability of self-treating wellbore fluids. A current practice is to run a wireline logging system through the inside of the drill pipe. Circulation subs may be used in the drill string on top of (uphole from) the logging tools. However, the circulation flow rate will be limited to a flowrate that is too low to treat and shear wellbore fluids. This limited flow rate cannot meet the requirement of shearing the wellbore fluids for treatment, especially when the logging tools have to be run to log inside larger ODs of openhole, e.g., 12¼" hole size. The higher flow rate necessary to achieve turbulent flow for treating and shearing the wellbore fluids will flush out and damage the wireline cable inside the drill pipes. In current practice, the current logging string is likely to be differential-stuck during the stationary time period, in horizontal laterals, whenever wellbores have high overbalanced hydrostatic pressure against formation pressure.

The disclosed method and system allow the logging string to perform formation logging in the wellbore and to treat the wellbore fluids automatically and continuously after being run to the desired depth. The OHL-TS method and system disclose logging the wellbore and automatically and continuously treating the wellbore fluids.

FIG. 1 illustrates an example well site 100. Well sites may be configured in a myriad of ways; therefore, the well site 100 is not intended to be limiting with respect to the particular configuration of the drilling equipment. The well site 100 is depicted as being on land. In other examples, the well site 100 may be offshore, and drilling may be carried out with or without use of a marine riser. A well drilling operation at the well site 100 may include drilling a wellbore 104 with a wellbore fluid 106 from the surface of the earth (e.g., surface 122) into a subsurface including various types of the formation 132. For the purpose of drilling a new section of wellbore 104, a drill string 120 is suspended within the wellbore 104. The drill string 120 may include one or more drill pipes connected to form a conduit and a bottom hole assembly (a BHA 128) disposed at the distal end of the conduit. The BHA 128 may include a drill bit 130 to cut into the subsurface rock. The BHA 128 may include measurement tools, such as a measurement-while-drilling (MWD) tool or a logging-while-drilling (LWD) tool (not shown), as well as other drilling tools that are not specifically shown but would be understood to a person of ordinary skill in the art.

The drill string 120 may be suspended in wellbore 104 by a derrick (e.g., a derrick structure 102). A crown block 112 may be mounted at the top of the derrick structure 102. A traveling block 114 may hang down from the crown block 112 by means of a cable or drill line (e.g., drill line 108). One end of the drill line 108 may be connected to a drawworks, which is a reeling device that can be used to adjust the length of the drill line 108 so that the traveling block 114 may move up or down the derrick structure 102. The top drive 118 is coupled to the top of the drill string 120 and is operable to rotate the drill string 120. Alternatively, the drill string 120 may be rotated by means of a rotary table (not shown) on the surface 122. The drill string is used with a BOP (e.g., blowout preventer 136). The BOP may be used to seal the well. Drilling fluid (commonly called mud) (not shown) may be pumped from a mud system 134 into the drill string 120. The mud may flow into the drill string 120 through appropriate flow paths in the top drive 118, or through a rotary swivel if a rotary table is used (not shown). Details of the mud flow path have been omitted for simplicity, but would be readily understood by a person of ordinary skill in the art.

During a well drilling operation at the well site 100, the drill string 120 is rotated relative to the wellbore 104 and weight is applied to the drill bit 130 to enable the drill bit 130 to break rock as the drill string 120 is rotated. In some cases, the drill bit 130 may be rotated independently with a drilling motor (not shown). In other embodiments, the drill bit 130 may be rotated using a combination of a drilling motor (not shown) and the top drive 118 (or a rotary table if used instead of a top drive) to rotate the drill string 120. While cutting rock with the drill bit 130, mud is pumped into the drill string 120. The mud flows down the drill string 120 and exits into the bottom of the wellbore 104 through nozzles in the drill bit 130. The mud in the wellbore 104 then flows back up to the surface 122 in an annular space between the drill string 120 and the wellbore 104 carrying entrained cuttings to the surface 122. The cuttings are removed and the fluid is returned to the mud system 134 to be recycled and circulated back again into the drill string 120. The components of the drill site may collectively be referred to as a drilling rig 138.

Well drilling operations are completed upon the retrieval of the drill string 120, the BHA 128, and the drill bit 130 from the wellbore 104. In some embodiments of wellbore 104 construction, the production casing operations may commence. Production casing operations includes installing casing in the wellbore. A casing string 124, which is made up of one or more larger diameter tubulars that have a larger inner diameter than the drill string 120 but a smaller outer diameter than the wellbore 104, is lowered into the wellbore 104 on the drill string 120. Generally, the casing string 124 is designed to isolate the internal diameter of the wellbore 104 from the formation 132. Once the casing string 124 is in position, it is set and cement is pumped down through the internal space of the casing string 124, out of the bottom of the casing shoe 126, and into the annular space between the wellbore 104 and the outer diameter of the casing string 124. This secures the casing string 124 in place and creates the desired isolation between the wellbore 104 and the formation 132. At this point, drilling of the next section of the wellbore 104 may commence.

Figure 2:
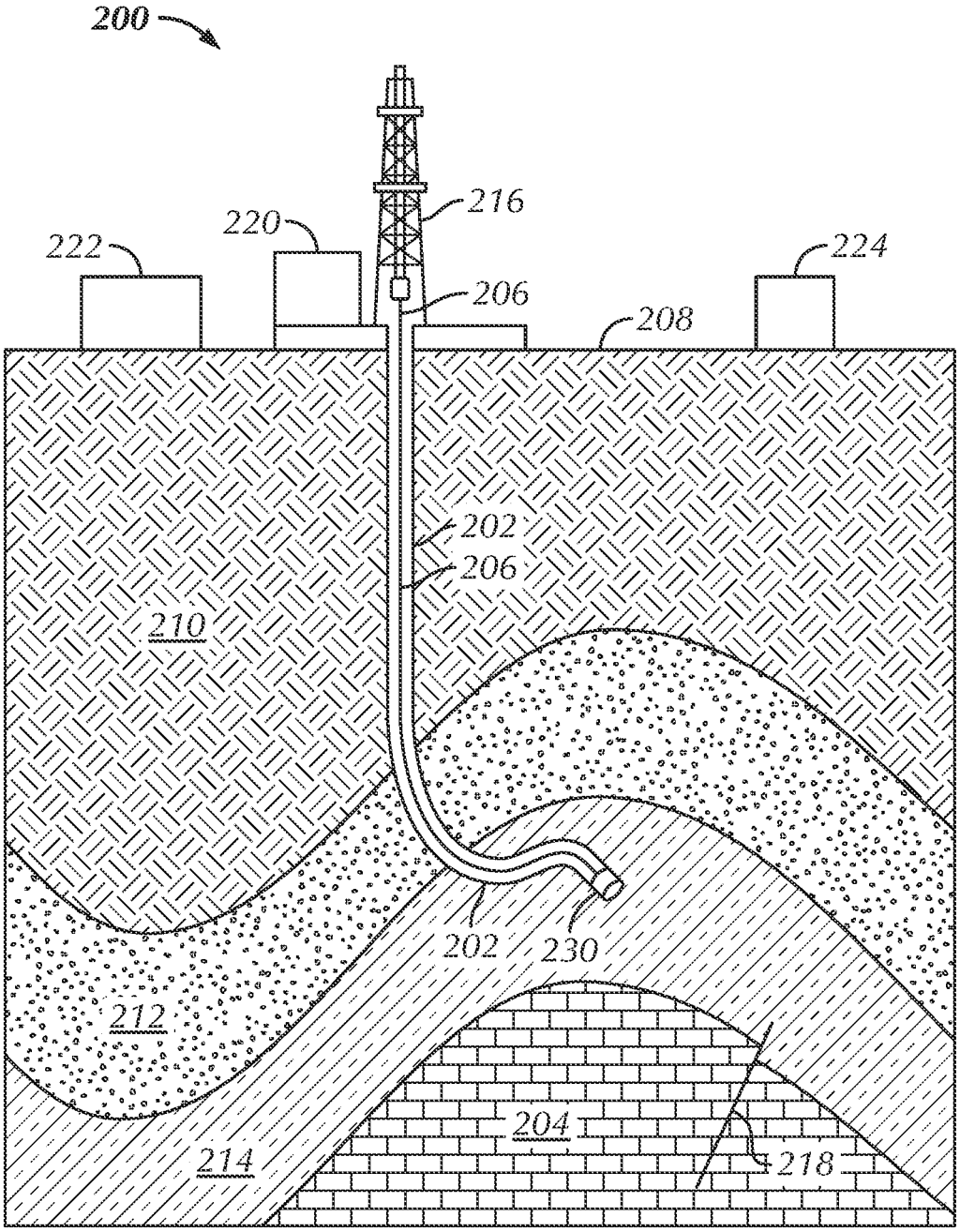
FIG. 2 illustrates an example logging site in accordance with one or more embodiments.

FIG. 2 shows depicts a petroleum system 200 in accordance with one or more embodiments. The petroleum system 200 includes a source rock formation 204, or rocks in which hydrocarbons have been generated or are capable of hydrocarbon generation. A source rock formation 204 is one of the necessary elements of the petroleum system 200 and includes organic-rich sediments that may be deposited in a variety of environments. When these organic-rich sediments are heated sufficiently, hydrocarbons may be created. With hydrocarbons present in a source rock formation 204 the petroleum system 200 requires a migration of these hydrocarbons into a hydrocarbon reservoir formation (e.g., reservoir 214). The hydrocarbons may migrate vertically through faults (e.g., fault 218) or fractures upwards into the reservoir 214. The fault 218 depicted in FIG. 2 fractures and displaces the source rock formation 204, allowing for the escape of the hydrocarbons in these cases. Hydrocarbon migration may also occur as a near-vertical migration from the reservoir 214 due to a buoyancy-driven flow of hydrocarbons. A buoyancy-driven flow of hydrocarbons occurs when the upward buoyancy force of the hydrocarbons is greater than the downward force of gravity, causing an upward migration. Migration may be local, as shown in the petroleum system 200 of FIG. 2 or may occur over distances of hundreds of kilometers in larger sedimentary basins and is a crucial mechanism to the formation of a viable petroleum system.

The reservoir 214 contains an accumulation of hydrocarbons including oil and/or natural gas. The reservoir 214 is usually a permeable and porous rock layer capable of storing and transmitting hydrocarbon fluids. Reservoirs (such as reservoir 214) are formed under temperature conditions that may preserve the hydrocarbons and are overlain by an impermeable layer or layers of rock, known as a hydrocarbon seal (e.g., seal 212). The seal 212 acts as a barrier to stop the further migration of hydrocarbons and may be accompanied with an appropriate topographic structure, such as an anticline which helps to further trap the accumulation of hydrocarbons within the reservoir 214. By understanding the regional relationships between the play risk elements of the petroleum system 200, which include information regarding the source rock formation 204, the reservoir 214, the seal 212 and the hydrocarbon charge, the veracity of PBE may be improved. The hydrocarbon charge describes a likelihood of forming hydrocarbons of a petroleum system 200, migrating, and being trapped in the reservoir 214 for economic extraction.

A hydrocarbon exploration may be conducted on a prospective petroleum system by drilling into the suspected reservoir (e.g., reservoir 214) in order to detect, quantify, or extract the hydrocarbons. A wellbore 202 may be drilled by a drill bit 230 attached by a drill pipe 206 to a drill rig 216 located on the surface 208 of the Earth. The wellbore 202 may traverse a plurality of overburden layers 210 and one or more seal formations (e.g., seal 212) to a prospective hydrocarbon reservoir (e.g., reservoir 214). The wellbore 202 may be drilled to perform any number of tests to analyze and broaden the knowledge and understanding of the hydrocarbon characteristics of the reservoir 214, including determining well logs from a logging system 220.

The logging system 220 may include the tools to determine a well log, including tools from a wireline logging operation or a logging while drilling (LWD) operation. A logging tool may be lowered into the wellbore 202 to acquire measurements as the tool traverses a depth interval. The plot of the logging measurements versus depth may be referred to as a log or well log. For example, a logging tool may generate the energy (acoustic, nuclear, magnetic, electrical) that is transmitted into the formation. The logging tool may record the results of the log. The logging tool may store the results of the log and may transmit the results back to the surface. A well log from a logging tool may be termed a logging tool log. Well logs may provide depth measurements of the wellbore 202 that describe such reservoir characteristics as formation porosity, formation permeability, resistivity, water saturation, and the like. The resulting logging measurements may be stored or processed or both, for example, by a control system 222, to generate corresponding well logs for the wellbore 202. The logging tool may have a communication interface for receiving a command signal to begin recording the log, for example a command signal sent from the control system. The logging tool communication interface may be used for transmitting the logging data to the control system 222. The logging tool log may be acquired by, for example, a gamma ray logging tool. The gamma ray logging tool may be configured to acquire the gamma ray log upon receipt of a signal, such as a command signal, to begin logging. Furthermore, acquisition of the gamma ray log may commence after receipt of the signal to begin logging. A control system such as the control system 222 may send the command to begin logging. A well log and how it may be used to determine a depth interval containing a petroleum system element is explained in greater detail in FIG. 2.

Well test results 224, shown as a box in FIG. 1, may be taken from the wellbore 202 during the drilling or completion of the wellbore 202 and may include analyzing any available hydrocarbon show data. Hydrocarbon show data is any indication of oil and gas witnessed during well operations, including any hydrocarbons directly observed in drilling fluids, core samples, and cutting samples. Hydrocarbon show data may also include direct formation fluid samples taken at multiple intervals of the wellbore 202. Formation fluid samples or reservoir fluid samples may be retrieved and analyzed at the surface 208 during a well's production, or fluid recovery devices may be used during the drilling of the well to collect these fluid samples. These fluid samples may be analyzed, usually at a separate location such as a laboratory, to characterize the fluid composition to determine the type of fluid present. These fluid samples are analyzed to identify the presence of oil, gas, water, and combinations of multiple fluid types.

Well test results 224 may also include formation flow tests, which include taking several measurements while the formation fluids travel up the wellbore 202 to be collected. During the formation flow tests, the reservoir fluids are often channeled through a flowmeter (not shown) to determine a formation pressure, a hydrocarbon flow rate, and a fluid characterization. A hydrocarbon flow rate may be characterized as the volume of fluid that moves through a given cross-sectional area per unit time and is usually measured by a flowmeter. Determining a hydrocarbon flow rate may aid in determining certain reservoir formation characteristics such as the volume of hydrocarbons present in the reservoir 214 and the permeability of the formation. Permeability describes the ability for fluids to pass through the formation and is crucial in determining the quality of the reservoir 214 present. These well test results 224, which may include any sampled fluids or a hydrocarbon flow rate, may be used in combination with well logs to determine a petroleum system description for a particular reservoir depth interval. The above petroleum system descriptions may describe hydrocarbon test and show data in addition to seal and source rock quality determined based, at least in part, on the well logs and the well test results 224. Further, the petroleum system descriptions are shown on a visual representation in FIG. 2, which helps to understand a regional petroleum system (e.g., petroleum system 200).

While a single wellbore (e.g., wellbore 202) is illustrated in the petroleum system 200, hydrocarbon exploration and/or production typically involves a plurality of wellbores positioned at various locations of the reservoir 214. By collecting all the available data from the plurality of wellbores, including any well logs and the well test results 224, a greater understanding of the petroleum system 200 may be developed. Decisions, including determining a new drilling target location, may be made based, at least in part, on this increased understanding of the petroleum system 200. For example, well log data are commonly used to estimate reservoir properties including porosity, fluid saturation, and permeability, which are required for reservoir modeling, reserves estimation, and production forecasting. In some key wells, rock samples (e.g., the core 319) are also taken out of the borehole through a coring while drilling operation.

Figure 3:
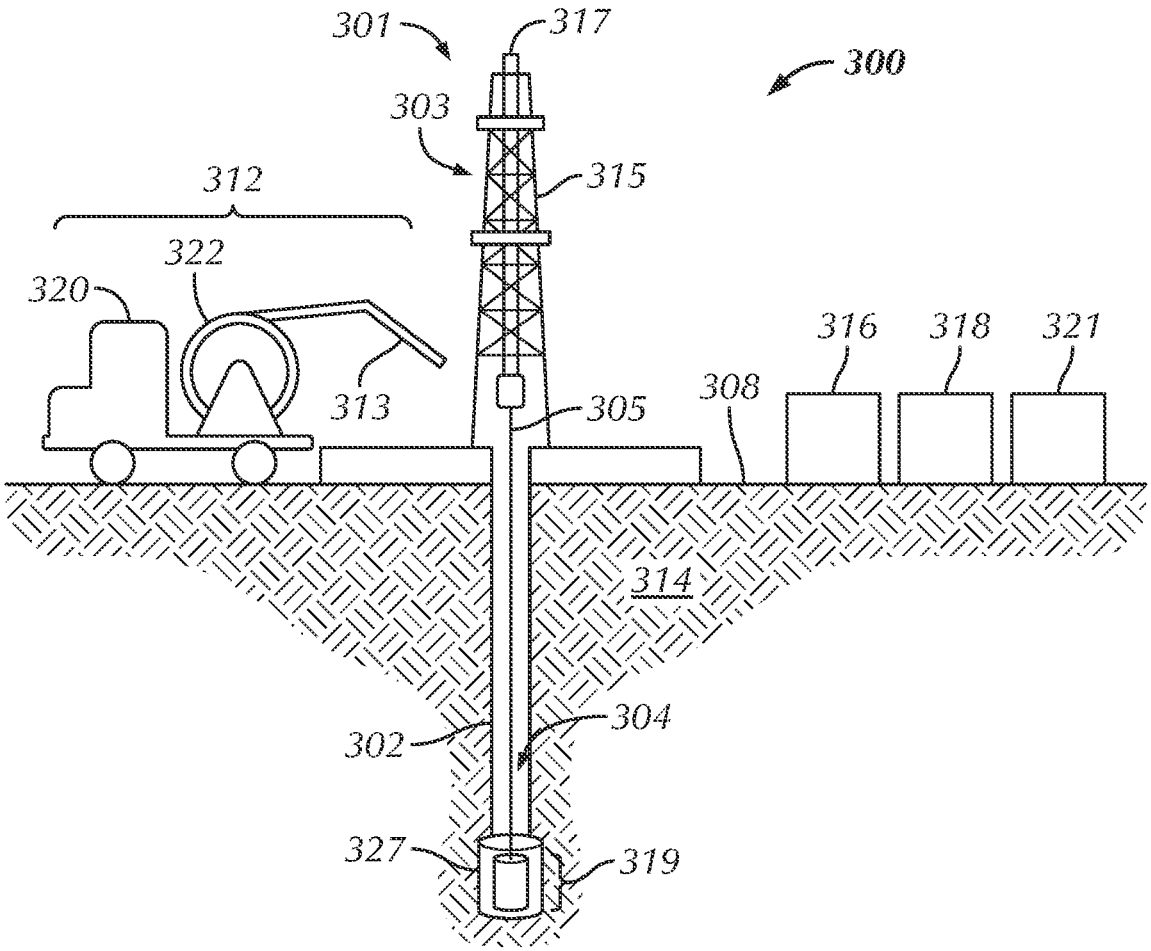
FIG. 3 illustrates an example coring site in accordance with one or more embodiments.

FIG. 3 shows a core sampling system and a logging system in accordance with one or more embodiments. A geological model is used to represent the earth. The geological model may be obtained using seismic data. Seismic data may be subject to depth errors such as the core shift. A core sampling system 301, in accordance with one or more embodiments, may include, for example, a coring rig, a conveyance such as wireline or drill pipe, a sidewall coring system, a core bit, an inner barrel, and/or an outer barrel. After a well 302 is drilled, core samples may be taken using the core sampling system 301 and wireline logs may be run using a wellbore logging system. The wellbore logging system may produce drill pipe-deployed well log or a wireline well log that may be uncalibrated, e.g., an uncalibrated well log or uncalibrated well logs. Uncalibrated well logs without core samples may be used to form an uncalibrated geophysical model. The core samples and the uncalibrated well logs may be integrated to produce a calibrated geophysical model. The calibrated geophysical model may then be used to define drilling targets.

A method for taking a core sample includes use of a drilling system 303. The drilling system may include the well 302 and a coring bit 327 attached by a drill string 305 to a coring rig 317. The formation (e.g., reservoir 314) may be cored to produce rock core samples (e.g., core 319) for analysis. Coring operations may include physically extracting a core sample from a region of interest within a wellbore 304 by the coring bit and bringing it to the surface 308 for examination. A second coring technique, termed sidewall coring, may also be used to extract a core sample. Two techniques are used for obtaining sidewall cores. In rotary sidewall coring, mechanical tools may use hollow rotary drills to cut through the sidewall rock formation producing rotary sidewall cores. In percussion sidewall coring a tool uses a propellant to shoot a hollow, retrievable, cylindrical bullet into the wellbore wall. For example, the percussion sidewall coring and rotary side wall coring may be discrete depth indexed in separate runs. To align their depth to the reference log in a particular run may include aligning the two Gamma ray logs acquired in the two runs. Following development of a depth shift table, the depth shift values may be applied to the depths of sidewall coring points.

The core samples (e.g., core 319), usually cylindrical, may be analyzed in a laboratory to determine various reservoir characteristics from the location from which the sample was obtained. These reservoir characteristics may include porosity, pore size distribution, permeability, or the presence of hydrocarbons. Porosity may indicate how much void space or pore space exists in a particular rock within the formation (e.g., reservoir 314), where oil, gas or water may be trapped. Pore size distribution describes the relative abundance of each pore size in a particular rock and permeability may indicate the ability of liquids and gases to flow through the rock within the area of interest.

Core samples are obtained from rock that is under compressive stress. Upon removal of a core from its source rock, the core is relieved of the compressive stress and therefore the core may expand. This relief of compressive stress is termed unloading. The core sample unloading is one of the operational factors that leads to the depth mismatch.

The wellsite 300 may include a control system 316, having hardware and/or software for managing drilling operations, logging operations and/or maintenance operations. For example, the control system may include one or more programmable logic controllers (PLCs) that include hardware and/or software with functionality to control one or more processes performed by the drilling system 303. The wellsite may also include a logging system 312 with one or more logging tools (e.g., a logging tool 313), such as a gamma ray logging tool and a nuclear magnetic resonance (NMR) logging tool for use in generating well logs of the formation. Following the removal of the drilling system, the logging system may be lowered into the wellbore to acquire measurements as the tool traverses a depth interval. The plot of the logging measurements versus depth may be referred to as a log or well log.

Well logs may provide depth measurements of the well that describe reservoir characteristics including formation porosity, formation permeability, resistivity, water saturation, and the like. The resulting logging measurements may be stored or processed or both, for example, by the control system 316, to generate corresponding well logs for the well. The control system 316, the seismic processing system 318, or the seismic interpretation workstation 321 may send the command to the logging tool to begin logging. The logging system may be supported by a truck 320 and derrick 315 above ground. For example, the truck may carry a conveyance mechanism 322 used to lower the logging tools into the wellbore. The conveyance mechanism may be a wireline, coiled tubing, or drill pipe that may include means to provide power to the well logging system and a telemetry channel from the well logging system to the surface. In some embodiments, the well logging system may be translated along the depth of the wellbore to a designated depth (or more than one designated depth or range of depths) to acquire a well log over multiple depth intervals.

The logging tools may include, but are not limited to caliper, electrical resistivity, resistivity image, electromagnetic, acoustic logging tools, acoustic image logging tools, neutron, and gamma ray logging tools. Thus, the well log acquired from the well logging system may be an acoustic log, acoustic image log, electrical resistivity, or resistivity image log. For example, a gamma ray log measures radioactivity found naturally in the formation. In the case of a gamma ray log, the log measures a gamma-ray emission property of the logged area such as rock, core, wellbore, borehole, or formation. A term of art is eLog which refers to electrical wireline log. Another example is an NMR logging tool which measures the induced magnetic moment of hydrogen nuclei (specifically, protons) contained within the fluid-filled pore space of porous media (for example, reservoir rocks). Various logging tools may measure porosity, permeability, pore size, pore-size distribution and the types of fluids present in the pore spaces. These reservoir characteristics are pertinent for reservoir characterization.

Logs obtained by wireline may contribute to the depth mismatch due to the Yo-Yo effect. The wireline has an inherent stretch property. If or when the logging tool sticks or drags in the bore and then frees itself, the tool may travel up and down the wellbore, oscillating within a certain distance range. The oscillation range narrows as the Yo-Yo effect diminishes following a roughly second-order decay. At a point in time the logging tool stabilizes. Prior to the stabilization, depth records of the wireline tool may have a depth mismatch with respect the retrieved core.

Logs obtained by LWD may contribute to the depth mismatch due to vibration of the drilling operation. As the drill bit drills into the rock, the drill bit may vibrate in several axes. A logging tool coupled to the drill bit may record depth records that have a depth mismatch with respect to the retrieved core.

Core damage may contribute to the depth mismatch. Upon retrieval, the core integrity may be disturbed due to handling, packaging, and transportation. Disturbing the core integrity may result in core damage. For example, core damage may be generalized as improper stabilization of unconsolidated samples prior to shipping; time lag may exceed a time envelope for determining saturations; and lack of comprehensive information on the sample container or the accompanying data sheet may lead to improper handling and subsequent core damage. A damaged core may result in a depth mismatch with respect to the logged depth data.

Figure 4:
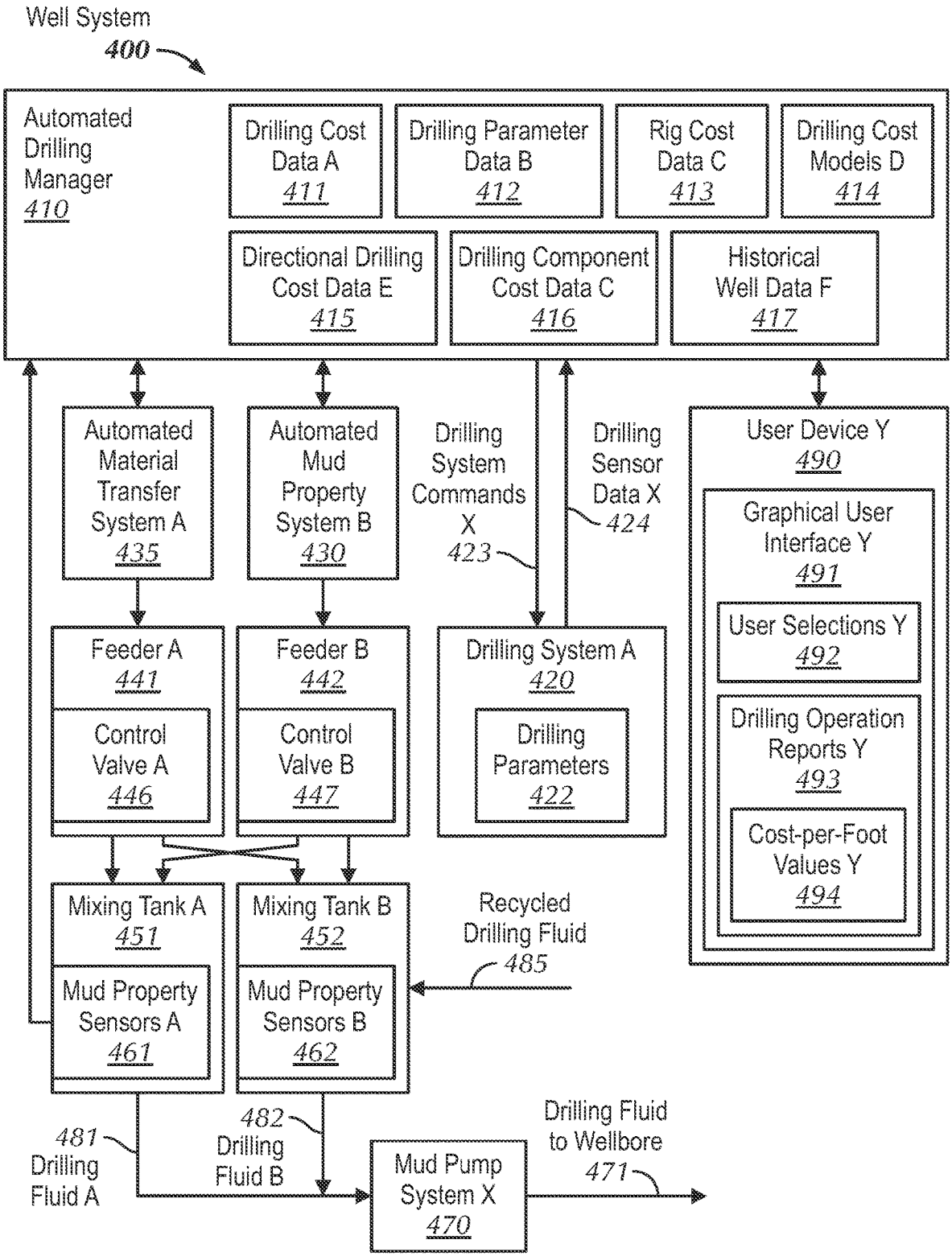
FIG. 4 illustrates an automated drilling manager in accordance with one or more embodiments.

FIG. 4 shows a system in accordance with one or more embodiments. Turning to FIG. 4, FIG. 4 shows a schematic diagram in accordance with one or more embodiments. As shown in FIG. 4, FIG. 4 illustrates a well system 400 that may include an automated drilling manager (e.g., automated drilling manager 410) coupled to one or more user devices (e.g., user device Y 490), a drilling system (e.g., drilling system A 420), a mud pump system (e.g., mud pump system X 470), an automated material transfer system (e.g., automated material transfer system A 435), an automated mud property system (e.g., automated mud property system B 430), and various drilling fluid processing components. For example, drilling fluid processing equipment may include one or more feeders (e.g., feeder A 441, feeder B 442), one or more control valves (e.g., control valve A 446, control valve B 447), one or more mixing tanks (e.g., mixing tank A 451, mixing tank B 452), and a solid removal system. An automated mud property system may include hardware and/or software that includes functionality for monitoring and/or controlling various chemical components used to produce drilling fluid. Likewise, the automated drilling manager may include hardware and/or software for monitoring and/or controlling one or more drilling operations performed by a drilling system.

With respect to the drilling system, drilling fluid may circulate through a drill string for continuous drilling, e.g., drilling fluid A 481 and drilling fluid B 482 as shown in FIG. 4, in order to circulate through a wellbore (e.g., drilling fluid to wellbore 471). In particular, the ability of the drilling fluid to carry drilled cuttings from a wellbore may be governed by several factors that relate to various drilling fluid properties (e.g., mud rheology, mud weight, etc.) and various drilling operation parameters (e.g., drilling parameters 422) such as drill pipe rotary speed (RPM), pipe eccentricity (i.e. axial location of the drill pipe), hole inclination angle, and rate of penetration (ROP). Likewise, used drilling fluid from a wellbore may be passed through a solid removal system prior to entering a mixing tank or being sent to a mud pump system. More specifically, a solid removal system may include equipment and other hardware for removing particular solids, such as drill cuttings and coarse aggregates, from used drilling fluid in order to recycle drilling fluid (e.g., recycled drilling fluid 485).

Furthermore, drilling fluid data (such as density data, lost circulation material (LCM) data, and mud velocity data) may correspond to different physical qualities associated with drilling mud, such as specific gravity values (also referred to as mud weight or mud density), viscosity levels, pH levels, rheological values such as flow rates, temperature values, resistivity values, mud mixture weights, mud particle sizes, mud pressures, mud velocities, and various other attributes that affect the role of drilling fluid in a wellbore. For example, a drilling fluid property may be selected by a user device to have a desired predetermined rheological value, which may include a range of acceptable values, a specific threshold value that should be exceeded, a precise scalar quantity, etc. As such, an automated drilling manager or another control system may obtain sensor data from various mud property sensors (e.g., mud property sensor A 461, mud property sensor B 462) regarding various drilling fluid property parameters. Examples of mud property sensors include pH sensors, density sensors, rheological sensors, volume sensors, weight sensors, flow meters, such as an ES flow sensor, etc. Likewise, sensor data may refer to both raw sensor measurements and/or processed sensor data associated with one or more drilling fluid properties.

With respect to mud pump systems, a mud pump system (e.g., mud pump system X 470) may include hardware and software with functionality for supplying drilling fluid to a wellbore at one or more predetermined pressures and/or at one or more predetermined flow rates. For example, a mud pump system may include one or more displacement pumps that inject the drilling fluid into a wellbore. Likewise, a mud pump system may include a pump controller that includes hardware and/or software for adjusting local flow rates and pump pressures, e.g., in response to a command from an automated drilling manager or other control system. For example, a mud pump system may include one or more communication interfaces and/or memory for transmitting and/or obtaining data over a well network. A mud pump system may also obtain and/or store sensor data from one or more sensors coupled to a wellbore regarding one or more pump operations. While a mud pump system may correspond to a single pump, in some embodiments, a mud pump system may correspond to multiple pumps.

With respect to mixing tanks, a mixing tank may be a container or other type of receptacle (e.g., a mud pit) for mixing various liquids, fresh mud, recycled mud (e.g., recycled drilling fluid 485), additives, and/or other chemicals to produce a particular type of drilling fluid (e.g., drilling fluid A 481, drilling fluid B 482). For example, a mixing tank may be coupled to one or more mud supply tanks, one or more additive supply tanks, one or more dry/wet feeders (e.g., feeder A 441, feeder B 442), and one or more control valves (e.g., control valve A 446, control valve B 447) for managing the mixing of chemicals within a respective mixing tank. Control valves may be used to meter chemical inputs into a mixing tank, as well as release drilling fluid into a mixing tank. Likewise, a mixing tank may include and/or be coupled to various types of drilling fluid equipment not shown in FIG. 4, such as various mud lines, liquid supply lines, and/or other mixing equipment.

In some embodiments, a well system includes an automated material transfer system (e.g., automated material transfer system A 435). In particular, an automated material transfer system may be a control system with functionality for managing supplies of bulk powder and other inputs for producing a preliminary mud mixture. For example, an automated material transfer system may include a pneumatic, conveyer belt or a screw-type transfer system (e.g., using a screw pump) that transports material from a supply tank upon a command from a sensor-mediated response. Thus, the automated material transfer system may monitor a mixing tank using weight sensors and/or volume sensors to meter a predetermined amount of bulk powder to a selected mixing tank.

Likewise, a well system may also include an automated mud property system (e.g., automated mud property system B 430) to control the supply of various additives to a mixing tank. In some embodiments, for example, an automated mud property system may include hardware and/or software with functionality for automatically supplying and/or mixing weighting agents, buffering agents, rheological modifiers, and/or other additives until a mud mixture matches and/or satisfies one or more desired drilling fluid properties. Examples of weighting agents may include barite, hematite, calcium carbonate, siderite, etc. A buffering agent may be a pH buffering agent that causes a mud mixture to resist changes in pH levels. For example, a buffering agent may include water, a weak acid (or weak base) and salt of the weak acid (or a salt of weak base). Rheological modifiers may include drilling fluid additives that adjust one or more flow properties of a drilling fluid. One type of rheological modifier is a viscosifier, which may be an additive with functionality for providing thermal stability, hole-cleaning, shear-thinning, improving carrying capacity as well as modifying other attributes of a drilling fluid. Examples of viscosifiers include bentonite, inorganic viscosifiers, polymeric viscosifiers, low-temperature viscosifiers, high-temperature viscosifiers, oil-fluid liquid viscosifiers, organophilic clay viscosifiers, and biopolymer viscosifiers.

In some embodiments, an automated drilling manager includes hardware and/or software with functionality for determining drilling cost data relating to a drilling operation. Drilling costs for a hydrocarbon well may be affected by five main categories: pre-spud costs, casing and cementing costs, rotating drilling costs, non-rotating costs, and trouble costs. Pre-spud costs may be associated with the rig size which is dependent on the hole diameter and depth as well as the longest casing string's length. The cost of casing and cementing may include casing and cementing materials and running them in place. Rotating drilling costs are encountered once the bit is rotating and are included in costs associated with the rate of penetration (ROP) such as drilling fluid and drill bits. Moreover, non-rotating costs may include costs when the drill bit is not rotating, such as costs that include tripping operations and well control. Lastly, well costs may also include trouble costs based on unplanned incidents which take place during a drilling operation such as stuck pipe, lost circulation, and well control problems. In contrast to other costs of a drilling operation, rotating costs may represent an influencing factor that may increase or decreasing the overall cost of drilling. Multiple fixed costs may contribute to drilling costs, such as rig costs (e.g., based on rig cost data C 413), directional drilling costs (e.g., based on directional drilling cost data E 415), and various fixed component costs (e.g., based on drilling component cost data C 416). Current drilling costs may be benchmarked with respect to historical performance at similar wells. For example, historical wells may be selected based on historical well data (e.g., historical well data F 417) that describes geological formations, hole sizes, location of wells, type of drilling mode for the respective well, and bit types used. In some embodiments, an automated drilling manager includes functionality for using one or more drilling cost models (e.g., drilling cost models D 414) to determine drilling cost data (e.g., drilling cost data A 411).

In some embodiments, an automated drilling manager transmits one or more commands (e.g., drilling system commands X 423) to various control systems in a well system (e.g., drilling system A 420, automated material transfer system A 435, automated mud property system B 430) in order to produce drilling operations with specific drilling parameters. For example, drilling parameters may include specific drilling fluid properties, such as predetermined density values or mud velocity values of a drilling fluid (e.g., drilling fluid A 481, drilling fluid B 482, recycled drilling fluid 485). Likewise, drilling parameters data (e.g., drilling parameter data B 412) may also include data that describes drill string properties, such as a specific weight-on-bit or rate of penetration (ROP) values. Commands may include data messages transmitted over one or more network protocols using a network interface, such as through wireless data packets. Likewise, a command may also be a control signal, such as an analog electrical signal, that triggers one or more operations in a particular control system (e.g., drilling system A 420).

Furthermore, an automated drilling manager may monitor various drilling fluid properties and drilling parameters in real-time. For example, drilling fluid properties may be monitored using one or more mud property sensors. Likewise, drilling parameters may be modified in real-time based on downhole sensors, drilling sensors (e.g., using drilling sensor data X 424), etc. In some embodiments, for example, the automated drilling manager modifies drilling parameters at predetermined intervals until user-defined properties are achieved by the well system 400. The user-defined properties may correspond to a selection by a user device (e.g., user selection Y 492 obtained by user device Y 490 using a graphical user interface Y 491). For example, an automated drilling manager may be coupled to a user device e.g., over a well network, or remotely (e.g., through a remote connection using Internet access or a wireless connection at a well site). Based on real-time updates received for a current drilling operation (e.g., cost-per-foot values Y 494 from drilling operation reports Y 493), a user and/or the automated drilling manager may modify previously-selected drilling parameters, e.g., in response to changes in a drill bit while drilling or drilling fluid within the wellbore.

Keeping with FIG. 4, an automated drilling manager, an automated material transfer system, and/or an automated mud property system may include one or more control systems that include one or more programmable logic controllers (PLCs). Specifically, a programmable logic controller may control valve states, fluid levels, pipe pressures, warning alarms, and/or pressure releases throughout a well system. In particular, a programmable logic controller may be a ruggedized computer system with functionality to withstand vibrations, extreme temperatures, wet conditions, and/or dusty conditions, for example, around a drilling rig. In some embodiments, the automated drilling manager 410, the automated material transfer system A 435, the automated mud property system B 430, and/or the user device Y 490 may include a computer system that is similar to the computer system (e.g., computer 902) described below with regard to FIG. 9 and the accompanying description.

During some well operations, a lost circulation event may occur that results in a partial or complete loss of drilling fluid and/or cement slurry into a formation. For example, a lost circulation event may be brought on by natural causes or induced causes within the formation. Natural causes may include naturally-occurring fractures or caverns adjacent to a wellbore as well as unconsolidated zones. Induced causes may include a situation when a hydrostatic fluid pressure exceeds a fracture gradient of the formation resulting in a fracture receiving fluid rather than resisting the fluid. When drilling into highly fractured formations, for example, severe fluid losses may be encountered that pose serious threats to drilling operations. Fluid losses may lead to various risks such as high costs of replacing drilling fluid during the drilling operation, formation damage left behind by lost circulation treatments, and even a possible loss of hydrostatic pressure that can cause an influx of gas or fluid, e.g., resulting in a well blowout.

With respect to drilling operations, various types of lost circulation material (LCMs) may be used in a lost circulation treatment to prevent or reduce drilling fluids from being lost inside downhole formations. LCM examples may include fibrous materials (e.g., cedar bark, shredded cane stalks, mineral fiber, and hair), flaky materials (e.g., mica flakes, pieces of plastic, and cellophane sheeting) or granular materials (e.g., ground and sized materials such as limestone, marble, wood, nut hulls, Formica, corncobs, and cotton hulls). A fibrous LCM may include long, slender, and flexible substances that are insoluble and inert, where the fibrous material may assist in retarding drilling fluid loss into fractures or highly permeable zones. A flaky LCM may be thin and flat in shape with a large surface area in order to seal off fluid loss zones in a wellbore and help stop lost circulation. A granular LCM may be chunky in shape with a range of particle sizes. LCMs may also include one or more bridging agents that may include solids added to a drilling fluid to bridge across a pore throat or fractures of an exposed rock thereby producing a filter cake to prevent drilling fluid loss or excessive filtration. Example bridging agents may include removable-common products include calcium carbonate (acid-soluble), suspended salt (water-soluble) or oil-soluble resins. In some embodiments, granular materials, flaky materials, and/or fibrous materials are combined into an LCM pill and pumped into a wellbore next to a zone experiencing fluid loss to seal the formation. Different types of LCM may have different costs. For example, bentonite may have a lower price than medium-grade mica or nut plug circulation materials.

In regard to automated mud processing systems, an automated mud processing system may include a controller coupled various feeders, various control valves, various mixing tanks, and/or a solid removal system for managing drilling fluid in a drilling operation. The controller may include hardware, such as a processor, coupled to various sensors around various well systems at a well site. With respect to a mixing tank, a mixing tank may be a container or other type of receptacle (e.g., a mud pit) for mixing various liquids, fresh mud, recycled mud, different types of LCMs, additives, and/or other chemicals to produce a particular drilling fluid mixture. For example, a mixing tank may be coupled to one or more mud supply tanks, one or more additive supply tanks, one or more dry/wet feeders, and one or more control valves for managing the mixing of chemicals within a respective mixing tank. Control valves may be used to meter chemical inputs into a mixing tank, as well as release drilling fluid into a mixing tank.

Figure 5A:
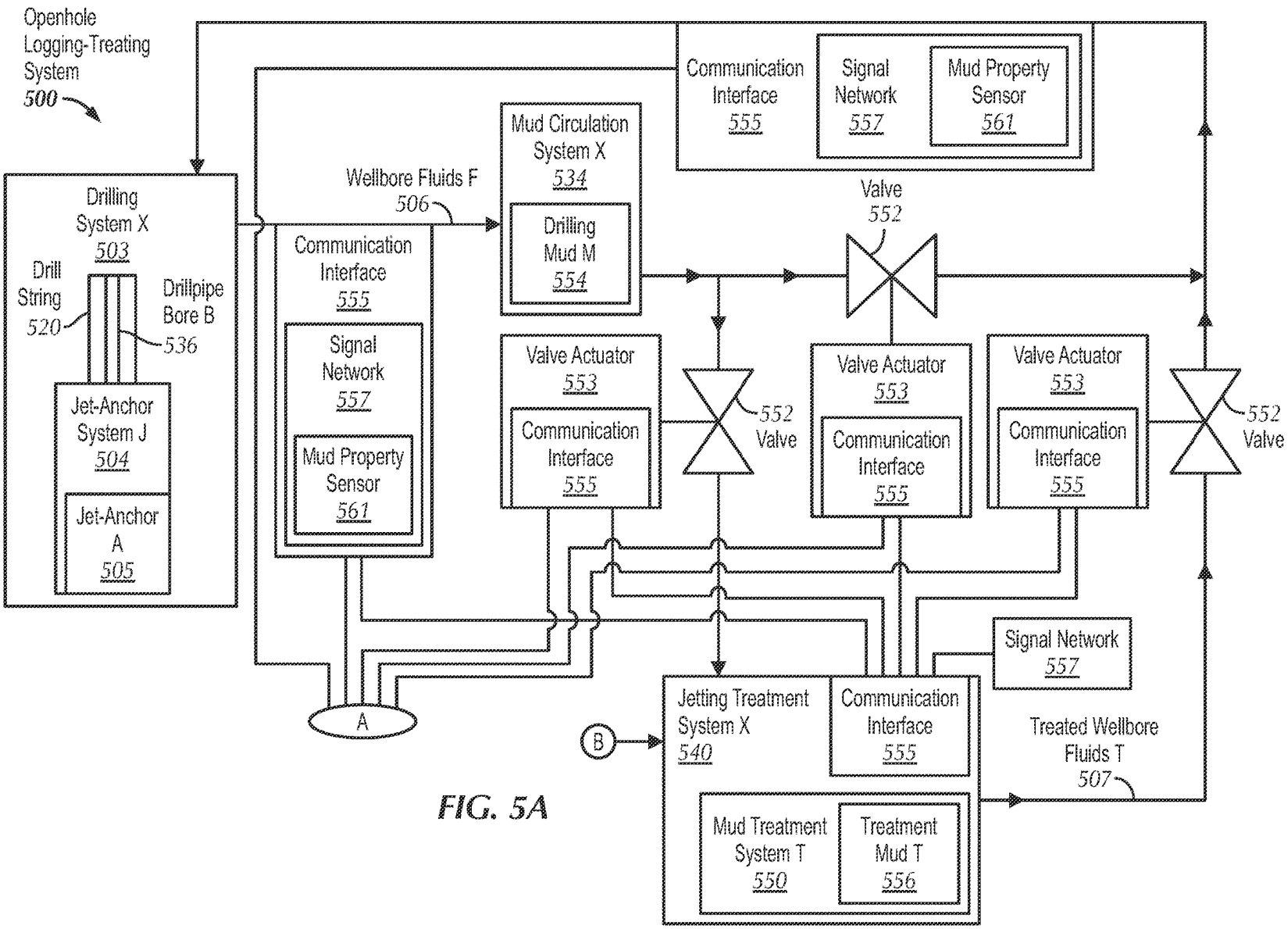
FIG. 5A, FIG. 5B, and FIG. 5C illustrate a system in accordance with one or more embodiments.
Figure 5B:
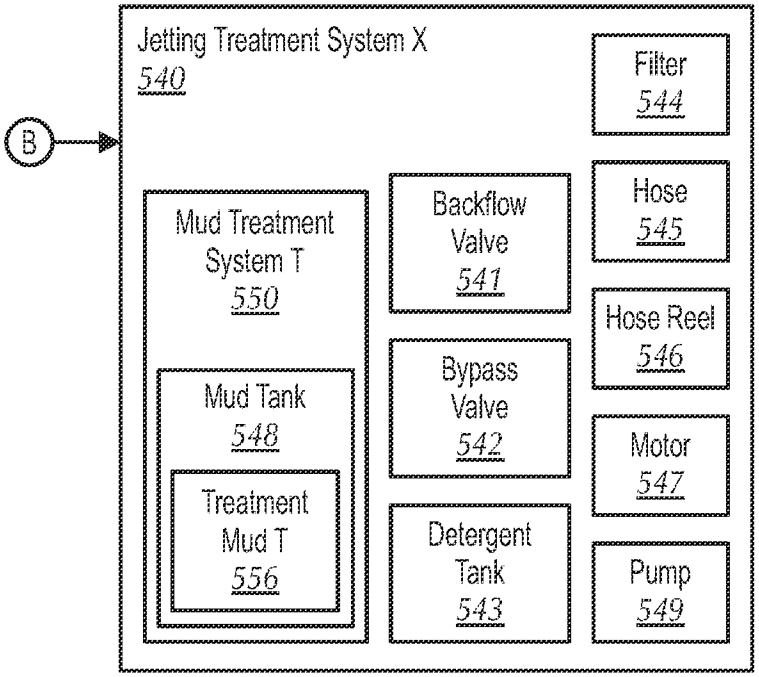
Figure 5C:
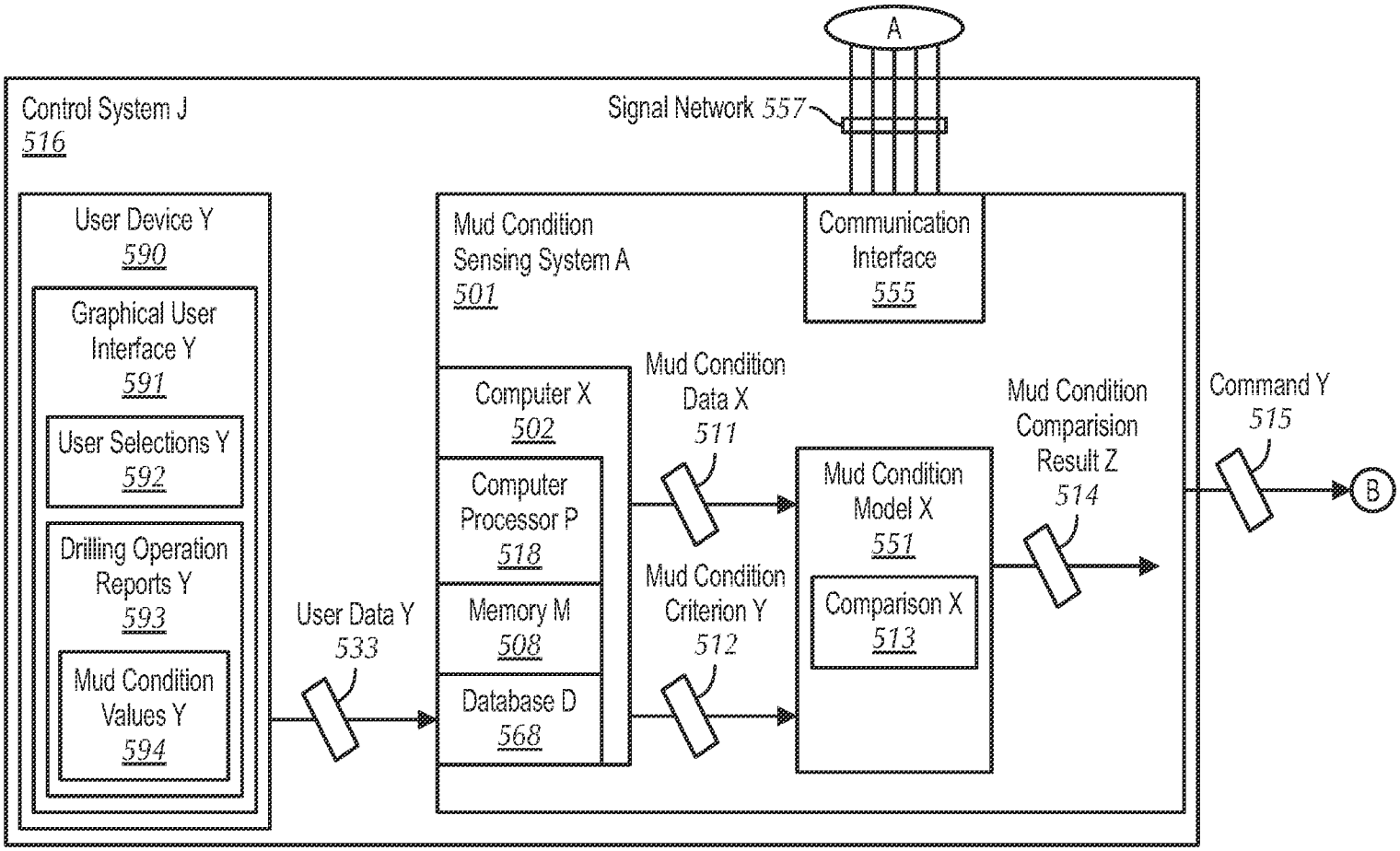

FIG. 5A, FIG. 5B, and FIG. 5C illustrate a system in accordance with one or more embodiments. FIG. 5A shows an openhole logging-treating system in accordance with one or more embodiments. FIG. 5A shows that the openhole logging-treating system (e.g., openhole logging-treating system 500) includes a drill string (e.g., drill string 520) of a drilling system (e.g., drilling system X 503) in hydraulic communication with a formation. The drilling system is configured for drilling a wellbore of a well in the formation. The drilling system includes a logging string with a jet anchor system (e.g., jet anchor system J 504). The jet anchor system is hydraulically coupled to the drilling system using, for example, the drill string 520. The jet anchor system includes a jet-anchor (e.g., jet-anchor A 505). The jet-anchor includes a jet nozzle and an anchor configured for coupling the logging string to the wellbore. The logging string is configured for deploying to a designated depth in the wellbore. Deploying the logging string may include coupling the jet-anchor to the wellbore. Coupling the jet-anchor may include forming a surface-surface contact between an anchor pad of an anchor on the jet-anchor and the wellbore or borehole. The surface-surface contact is formed by extending the jet-anchor out from the logging tool outer surface.

The openhole logging-treating system a jetting treatment system (e.g., jetting treatment system X 540) that includes a mud treatment system (e.g., mud treatment system T 550) configured for hydraulically coupling to a mud circulation system (e.g., mud circulation system X 534). The mud circulation system includes a drilling mud (e.g., drilling mud M 554) comprising wellbore fluids configured for hydraulically coupling to the mud circulation system. The mud circulation system is configured for hydraulically coupling to a drill string bore (e.g., drill string bore B 536) of the drill string. The mud circulation system, when activated, is configured to circulate the drilling mud in the wellbore.

The jetting treatment system is in hydraulic communication with the mud circulation system. A series of valves (e.g., valve 552), valve actuators (e.g., valve actuator 553), communication interfaces (e.g., communication interface 555), and a signal network (e.g., signal network 557) may couple mud condition sensing system (e.g., mud condition sensing system A 501) to the valves and to a series of mud condition sensors (e.g., mud property sensors C 561). The jetting treatment system may be hydraulically isolated from the mud circulation system X 534 and/or may be in hydraulic communication with the mud circulation system X 534 in accordance with various states of valve positions. For example, with open valves the jetting treatment system X 540 is in hydraulic communication with the mud circulation system X 534. The jetting treatment system, when activated, is configured to circulate the drilling mud in the mud treatment system. Activation of the jetting treatment system X 540 may include operating one or more of the valves (e.g., one or more of valves 552).

FIG. 5B illustrates a system in accordance with one or more embodiments. FIG. 5B shows that the jetting treatment system X 540 may include various components such as a backflow valve 541, a bypass valve 542, detergent tank 543, a filter 544, a hose 545, a hose reel 546, a motor 547, a mud tank 548, and a pump 549. These components may comprise the surface parts of the openhole logging-treating system 500. To prepare a treatment mud (e.g., treatment mud T 556), a predetermined volume of surface mud or drilling fluids (e.g., drilling mud M 554) is supplied by suction pump (e.g., pump 549) through the backflow valve and the filter into a separated internal mud tank (e.g., the mud tank 548). Treatment chemicals such as detergents supplied from the detergent tank may be added as necessary to the predetermined volume of surface mud. The addition of mud chemicals and/or detergents may be delivered to the treatment mud using a hose such as a low-pressure flow line.

The surface mud, having now been treated and still at low pressure, may be termed low-pressure treatment mud. The low-pressure treatment mud will be pumped and boosted to a high hydraulic pressure by a pump driver such as an electric motor (e.g., motor 547) coupled to the pump 549 to form a high-pressure treatment mud (e.g., treated wellbore fluids T 507). The high-pressure treatment mud is delivered through the bypass valve then through a high-pressure flow hose to the drill string. The high-pressure flow hose may be wound using the hose reel. The high-pressure treatment mud flows through the drill string bore (e.g., drill string bore B 536) inside drill pipe (e.g., drill string 520). The drill string 520 may be utilized to convey the logging tools. The high-pressure treatment mud is pumped through the drill string bore B 536 down to the jet anchor system J 504, then through the jet-anchor A 505 and out into the wellbore (external to the logging tool) through the jetting nozzles. The treated wellbore fluids T 507 injected into the wellbore through the jet-anchor A 505 may generate a turbulent flow. The mud inside the wellbore is thereby sheared and circulated, through jetting nozzles, from the bottom of wellbore up to the surface. The returned mud (e.g., wellbore fluids F 506) can be pumped to the separated internal mud tank (e.g., the mud tank 548) to continue supplying mud to the jetting treatment system X 540. In this manner, the downhole mud (wellbore fluids F 506) can be treated continuously without stopping the downhole logging operations.

The system includes the treatment mud T 556 disposed in the mud treatment system (e.g., mud treatment system T 550). The treatment mud is configured for treating the wellbore fluids while circulating in the wellbore using the jetting treatment system. The logging string is configured for logging the well, including core sampling. The system includes treated wellbore fluids (e.g., treated wellbore fluids T 507) that are formed from treating the wellbore fluids using the treatment mud. The mud circulation system, when deactivated, is configured to stop circulating the drilling mud in the wellbore. Likewise, the jetting treatment system, when deactivated, is configured to stop circulating the drilling mud in the mud treatment system. The logging string is configured to be retrieved from the wellbore. Retrieving the logging string may include decoupling the jet-anchor from the wellbore.

FIG. 5C illustrates a system in accordance with one or more embodiments. FIG. 5C shows that the system may include a control system (e.g., control system J 516). The control system may be coupled to one or more user devices (e.g., user device Y 590). Mud condition properties may be selected using the user device to have a desired predetermined mud condition value. In some embodiments, for example, the control system J modifies mud parameters at predetermined intervals until user-defined properties are achieved by the mud condition sensing system. The user-defined properties may correspond to a selection by a user device (e.g., user selection Y 592 obtained by user device Y 590 using a graphical user interface Y 591). For example, the control system J may be coupled to the user device e.g., over a well network, or remotely (e.g., through a remote connection using Internet access or a wireless connection at a well site). Based on real-time updates received for a current mud condition values (e.g., mud condition values Y 594 from drilling operation reports Y 593), a user and/or the control system J may modify previously-selected mud parameters, e.g., in response to changes in mud condition while drilling. The user data (e.g., user data Y 533) may be transmitted to the mud condition sensing system. The user data may be transmitted over the well network or remotely.

The method for drilling the wellbore may include using the mud condition sensing system for monitoring a first mud condition of the drilling mud circulated by the mud circulation system. The mud condition sensing system may obtain mud condition data (e.g., mud condition data X 511) from the monitoring. The values comprising the mud condition data may be received by a well control system. One or more of the received values in the mud condition data may be compared with stored drilling data such as stored mud condition data. The drilling may include using a computer processor (e.g., computer processor P 518) for comparing the first mud condition with a first predetermined criterion (e.g., mud condition criterion Y 512) to form a first comparison (e.g., comparison X 513). A computer (e.g., computer X 502) may use the computer processor P 518 along with a memory (e.g., memory M 508) and a database (e.g., database D 568) to perform a mud condition analysis using a mud condition model (e.g., mud condition model X 551). The drilling may include using the computer processor for determining a first result (e.g., mud condition comparison result Z 514) of the first comparison. The mud condition sensing system may use the mud condition comparison result to form a command (e.g., command Y 515) to transmit to the jetting treatment system. The drilling may include using a control system (e.g., control system J 516) for transmitting the activation signal to the jetting treatment system, based on the first result failing to satisfy the first predetermined criterion and for activating the jetting treatment system in response to receipt of the activation signal.

Likewise, the drilling may include using the mud condition sensing system for monitoring the mud condition data to determine a second mud condition of the drilling mud, using the computer processor for comparing the second mud condition with a second predetermined criterion to form a second comparison, then using the computer processor for determining a second result of the second comparison. The drilling may include using the control system for transmitting the deactivation signal to the jetting treatment system based on the second result satisfying the second predetermined criterion. The drilling may also include deactivating the jetting treatment system in response to receipt of the deactivation signal. The activation signal and/or the deactivation signal comprising the transmitted command may be in the form of a received signal which may be hydraulic, mechanical, electrical, electrical-mechanical, or wireless. The value of the received signal from the comparison result may be formed from a comparison of a single datum or of a data series of received data with some or all of the stored drilling data.

The drilling may include maintaining the wellbore fluids using the treated wellbore fluids, the jetting treatment system, the mud treatment system, the mud circulation system, and the drilling mud. Drilling the well may include deploying the logging string with the jet nozzle and an anchor to a designated depth in the wellbore. The formation may be an openhole formation and the designated depth may be a wellbore depth to an openhole formation depth. The openhole formation may have a high overbalanced hydrostatic pressure against a formation pressure. Treating the wellbore fluids may include shearing the wellbore fluids, preventing a solids fallback, and conditioning a filter cake.

Figure 6A:
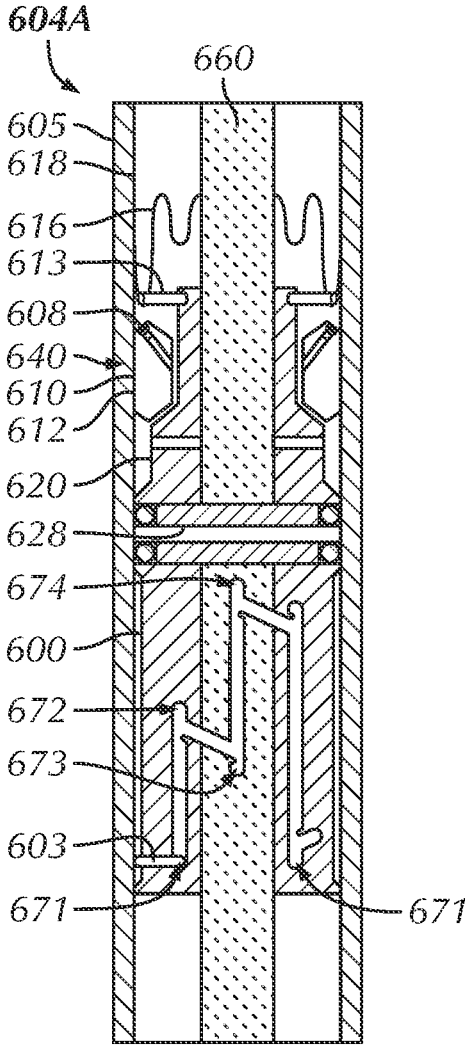
FIG. 6A, FIG. 6B, FIG. 6C, FIG. 6D, FIG. 6E, and FIG. 6F illustrate examples in accordance with one or more embodiments.

FIG. 6A, FIG. 6B, FIG. 6C, FIG. 6D, FIG. 6E, and FIG. 6F show example jet anchor systems in accordance with one or more embodiments. FIG. 6A shows an example jet anchor system (e.g., jet anchor system K 604A) in a deactivated state. A lower mandrel is shown in a downhole location with the jet anchor system. The lower mandrel is used for indexing the internal components of the logging tool. The lower mandrel may be known as an indexer. In FIG. 6A an indexer (e.g., indexer A 600) is shown in a first indexer setting. An upper mandrel is shown in an uphole location within the jet anchor system. The upper mandrel is used for locking the logging tool to the borehole. The upper mandrel may be known as a lock mandrel. In FIG. 6A a lock mandrel (e.g., lock mandrel L 620) and is shown in a disengaged position wherein a jet-anchor (e.g., jet-anchor B 606) is in a decoupled position (e.g., decoupled position D 640). The jet-anchor includes a jet nozzle N 608 and an anchor A 610. In accordance with one or more embodiments the jet anchor system may have one, two, three, four or more anchors. Each anchor may have one, two, or more jet nozzles. A predetermined flowrate may be configured by preselecting jet nozzle quantities and the bore diameter of each jet nozzle. The one or more nozzles may have predetermined nozzle bore diameters where each nozzle has the same nozzle bore or the nozzle bore diameters vary among the set of nozzles. The deactivated state includes the indexer in the first indexer setting and the jet-anchor in the decoupled position. The indexer A 600 has four indexer settings, a first indexer setting 671, a second indexer setting 672, a third indexer setting 673, and a fourth indexer setting 674.

Figure 6B:
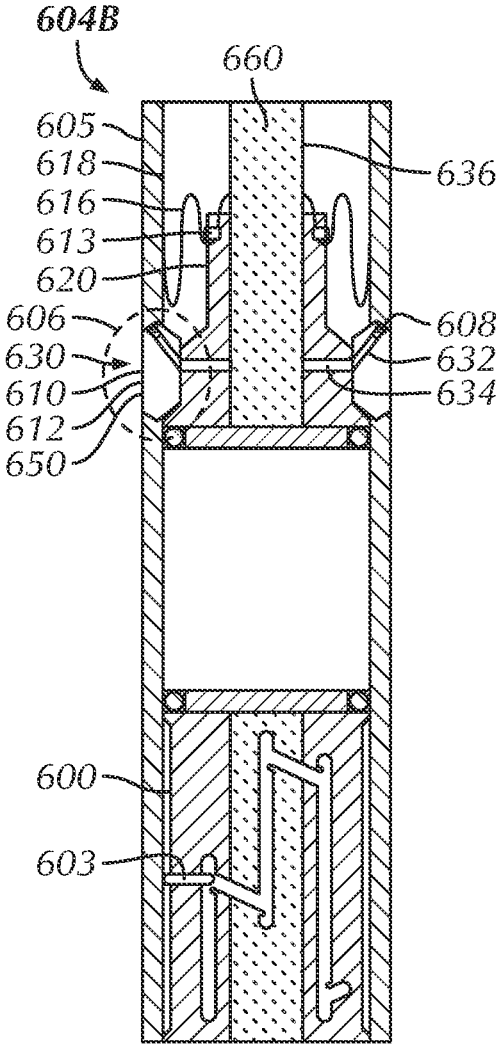

FIG. 6B shows an example jet anchor system (e.g., jet anchor system K 604B) in an activated state. In FIG. 6B, a drillpipe pressure (e.g., first drillpipe pressure input) of a substance (e.g., substance M 660) such as a drilling fluid, drilling mud, or wellbore fluid may be used as a pressure input. The pressure input may be applied to a mandrel driver (e.g., mandrel driver D 628) of a lock mandrel (e.g., lock mandrel N 624) to shift the lock mandrel N 624 to an engaged position wherein an anchor (e.g., anchor A 610) is shifted to a coupled position (e.g., coupled position C 630). The coupled position C 630 includes an anchor A 610 forming a surface-surface contact C 650 between an anchor pad P 612 and a wellbore B 605. The coupled position may align a hydraulic communication port (e.g., mandrel jet port P 634) from a drill string bore (e.g., drillpipe bore B 636) through a wall of the lock mandrel to a corresponding port (e.g., jet-anchor port P 632) in the anchor A 610. Alignment of the mandrel jet port with the jet-anchor port facilitates fluid communication between the drill string bore and the wellbore. Deploying the logging string may include coupling the logging string to the wellbore, for example, by activating the jet anchor system.

In the activated state of the jet anchor system and/or the coupled position of the jet-anchor, the jet-anchor port P 632 and the mandrel jet port P 634 may be configured to allow hydraulic communication between the drillpipe bore and the annular space between the tool outer surface and the wellbore. In the deactivated state and/or the decoupled state, the jet-anchor port P 632 and the mandrel jet port P 634 may be configured to prevent hydraulic communication between the drillpipe bore and the annular space between the tool outer surface and the wellbore. In the activated state and/or the coupled position, the jet nozzle may be configured to project outward from the anchor. In the deactivated state and/or the decoupled position, the jet nozzle may be configured to retract inward from the anchor.

FIG. 6B shows the indexer having moved from the first indexer setting to a second indexer setting in response to the first drillpipe pressure input. The drillpipe pressure input may be positive (e.g., pressurizing) or negative (e.g., depressurizing). For example, a negative drillpipe pressure input is depressurizing. Shifting of the indexer is guided by an indexer pin P 603 following one or more of a groove in the indexer. Subsequent changes in drillpipe pressures may result in changes to pressure inputs to the mandrel driver and to the indexer. Pressure input changes may cause a shift of the lock mandrel from the engaged position to the disengaged position in response to a second drillpipe pressure input.

Likewise, pressure input changes may cause a shifting from the second indexer setting to a third indexer setting in response to a second drillpipe pressure input. In like manner, subsequent cycling of the drillpipe pressures may result in cycling of pressure inputs to the mandrel driver and to the indexer thereby causing a shifting from the engaged position to the disengaged position, and from an indexer position n to an indexer position n+1 until a maximum number of positions is met ($n_{max}$), after which the indexer returns to the first indexer setting. For example, the indexer may shift from the third indexer setting to a fourth indexer setting in response to a third drillpipe pressure input, and the indexer may shift from the fourth indexer setting to the first indexer setting in response to a fourth drillpipe pressure input.

Shifting of the lock mandrel and the indexer may occur before, when, or after the downhole wellbore condition requires the jetting treatment system to activate. The activation may be in response to a predetermined condition being met or not being met, sensors commanding the system to start, etc. In the activated state, the logging tools will condition the drilling fluids including during logging of the well. In the coupled position, the anchors with the jetting nozzles extend out of a logging string body (e.g., tool outer surface S 618). In the activated state, the drilling fluids will be jetted through the nozzles to generate the turbulent flow. The drilling fluids will be pumped from a surface tank through a low-pressure flowline and jetted through a high-pressure flow line from the drill pipe, then come from bottom up of wellbore annulus between the logging tool string and the borehole. The wellbore flow returns to the surface tank again, where the drilling fluids can be treated with drilling fluids chemicals and materials on surface.

In accordance with one or more embodiments, the upper mandrel (e.g., the lock mandrel) will move upwards (uphole), while the lower mandrel (e.g., the indexer) will move downwards (downhole). The lock mandrel connects four anchors, each of which has one or more nozzles fixed inside. The anchors with nozzles expand while moving up by hydraulic force. In accordance with one or more embodiments the anchors cooperate with the logging tool body at an engagement ramp (e.g., engagement ramp 615) to move the anchors outward as they move upward. The lower mandrel moves down by hydraulic force while rotating with rotating sleeve. The anchors will hold against the wellbore, while the nozzles will jet the fluids away from the junk slots (e.g., junk slot 614) of the anchors to generate turbulent flow. When the lower mandrel (e.g., the indexer) moves downwards, it will rotate one quarter turn with a rotating sleeve, so that both the upper and lower mandrels will stop in position by a set of stop pins (e.g., stop pin S 613) following a stop path (e.g., stop path P 616), when the hydraulic force reduces after the rig pump stops pumping.

Upon completion of the logging operations, the hydraulic pressure inside the drill pipe will increase, then reduce right after the rotating sleeve rotates another one quarter turn. The jet-anchors (the anchors with nozzles) retract while moving downwards, and the lower mandrel (the indexer) moves up while rotating with rotating sleeve. As the inner pressure increases and reduces, the upper mandrel with the stop pins goes up to allow the rotating sleeve to rotate and move downwards as the stop pins go inside grooves after the sleeve rotates another quarter turn. In this way, this the jet anchor system can be utilized by adjusting the internal pumping pressure from the drill pipe. The anchors will help to hold the whole logging tools stable during jetting drilling fluids and the jetting will not affect the logging operations below the jet anchor system.

Returning to FIG. 6A, FIG. 6A shows that, when the openhole logging concludes, the jet-anchor B 606 will retract back inside the tool outer surface S 618, e.g., back into the jet anchor system K 604A, to the decoupled position. The jet-anchor retracts as the lock mandrel shifts downhole and the indexer shifts uphole by a drillpipe pressure input. For example, the drillpipe pressure may be reduced or removed (vented) or the drillpipe pressure may be increased to move the lock mandrel and the indexer. In the decoupled position, the logging operations conclude, and the logging tools can be pulled out of hole. In accordance with one or more embodiments the means for retracting the jet-anchor back into the tool and for moving the lock mandrel and the indexer may be provided by, for example a spring force.

Providing the spring force may include one or more springs, metallic springs, gas-charged springs, motors, linear actuators, electro-magnets, solenoids, hydraulic cylinders, gears, or jack screws and/or latches, locks, or braking mechanisms. Electrically-operated means for providing the spring force may be powered by a battery or batteries, or by an external power source, electrically coupled to the electrically-operated means. Moving the jet-anchor, the lock mandrel, and/or the indexer may be initiated by a deploy command to move the jet-anchor. The command may be sent, for example, from a control system and obtained by the jet anchor system. Those skilled in the art will readily appreciate that the means for coupling and the means for moving the various elements combining fasteners, bearings, and actuators may be configured without departing from the scope of this disclosure. The means of providing the spring force may include one or more of, and in any combination in compression or in tension, a coil spring, a constant tension spring, a torsion spring, and/or a gas-charged cylinder spring.

Figure 6C:
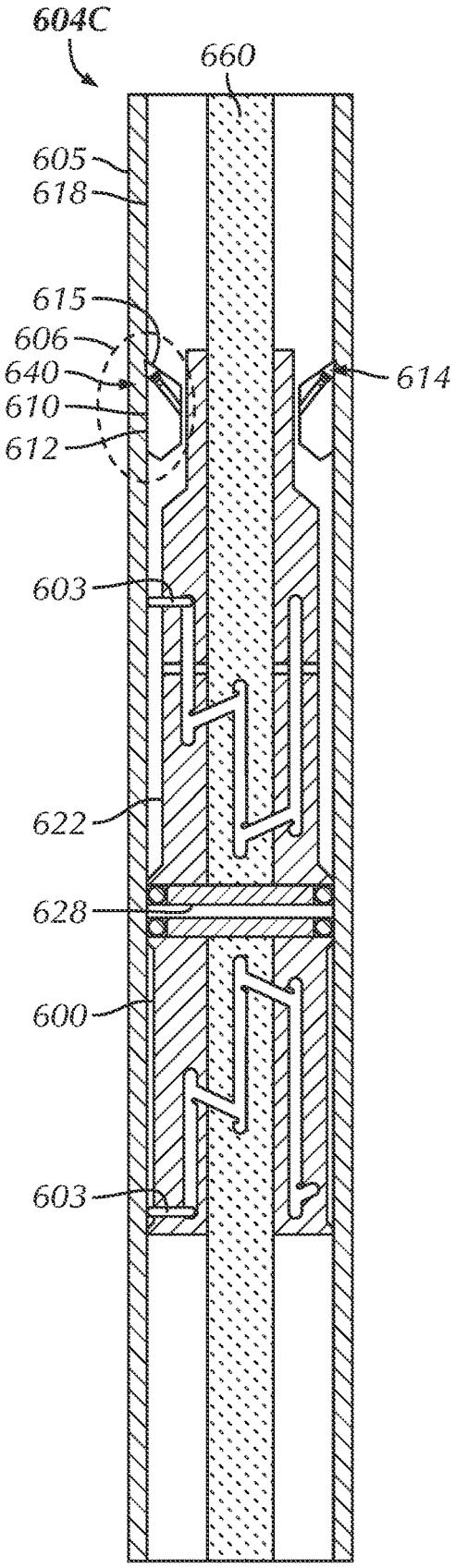

FIG. 6C shows an example jet anchor system K 604C in a disengaged state. In this embodiment a lock mandrel (e.g., lock mandrel M 622) has been fitted with an indexer pin P 603 and an indexer channel. The lock mandrel M 622 may rotate and change from one lock mandrel setting to another following a drillpipe pressure input. The lock mandrel M is shown with four lock mandrel settings.

Figure 6D:
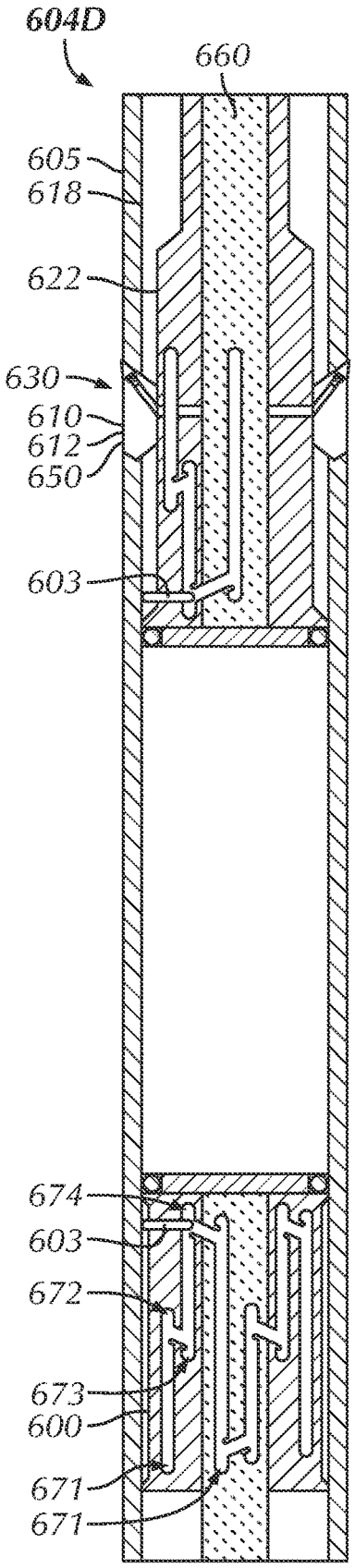

FIG. 6D shows an example jet anchor system K 604D in an engaged state. FIG. 6D shows the indexer A 600 having shifted from the first indexer setting 671 to the fourth indexer setting 674. FIG. 6D shows the lock mandrel M 622 having shifted from a first lock mandrel setting to a fourth lock mandrel setting. The coupled position C 630 includes an anchor A 610 forming a surface-surface contact C 650 between an anchor pad P 612 and a wellbore B 605. The coupled position may align a hydraulic communication port from a drillpipe bore through a wall of the lock mandrel to a corresponding port in the anchor A 610.

Figure 6E:
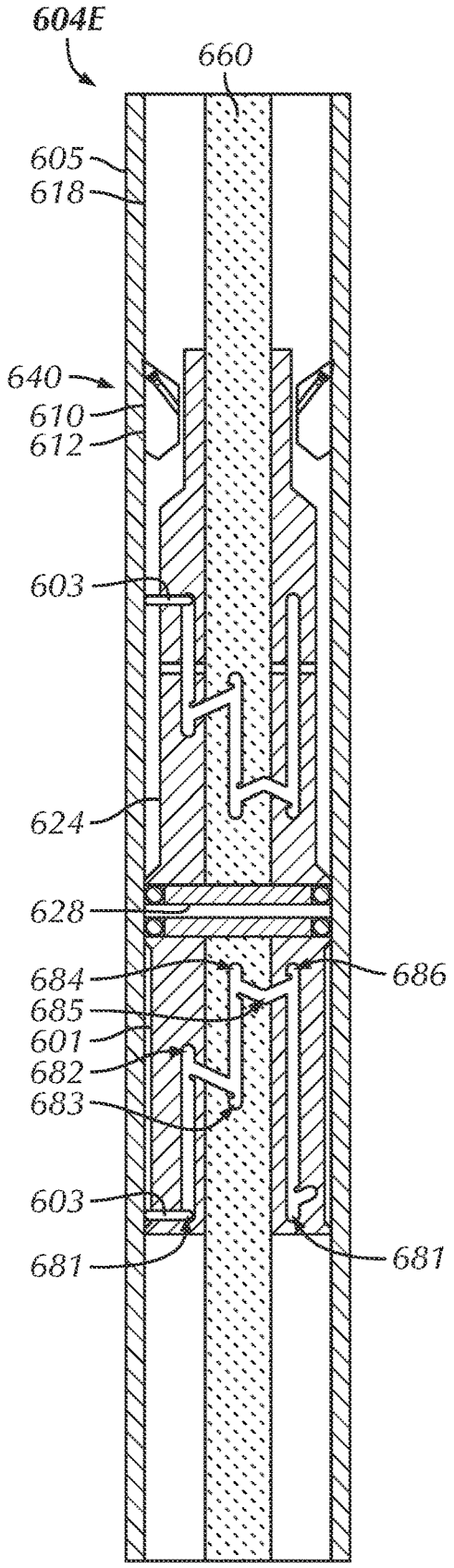

FIG. 6E shows an example jet anchor system K 604E in a disengaged state. FIG. 6E shows an indexer B 601 with six indexer settings, a first indexer setting 681, a second indexer setting 682, a third indexer setting 683, a fourth indexer setting 684, a fifth indexer setting 685, and a sixth indexer setting 686. FIG. 6E shows a lock mandrel (e.g., a lock mandrel N 624) in a disengaged position wherein a jet-anchor is in a decoupled position. Lock mandrel N is shown with six lock mandrel settings.

Figure 6F:
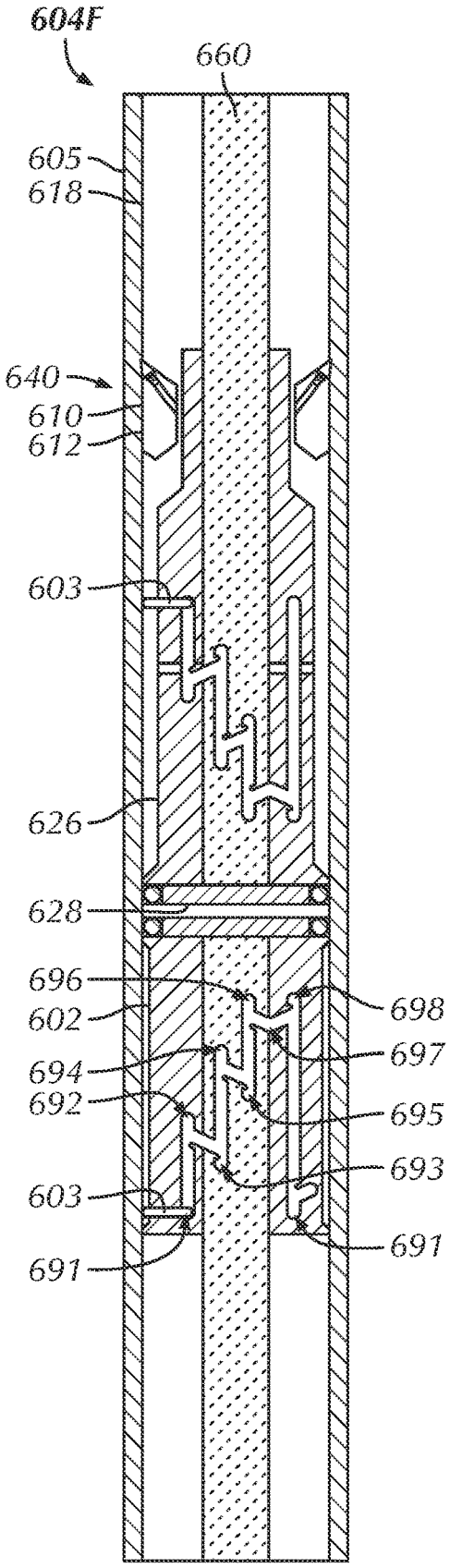

FIG. 6F shows an example jet anchor system K 604F in a disengaged state. FIG. 6F shows an indexer C 602 with eight indexer settings, a first indexer setting 691, a second indexer setting 692, a third indexer setting 693, a fourth indexer setting 694, a fifth indexer setting 695, a sixth indexer setting 696, a seventh indexer setting 697, and an eighth indexer setting 698. FIG. 6F shows a lock mandrel (e.g., a lock mandrel O 626) in a disengaged position wherein a jet-anchor is in a decoupled position. The lock mandrel O is shown with eight lock mandrel settings.

Figure 7A:
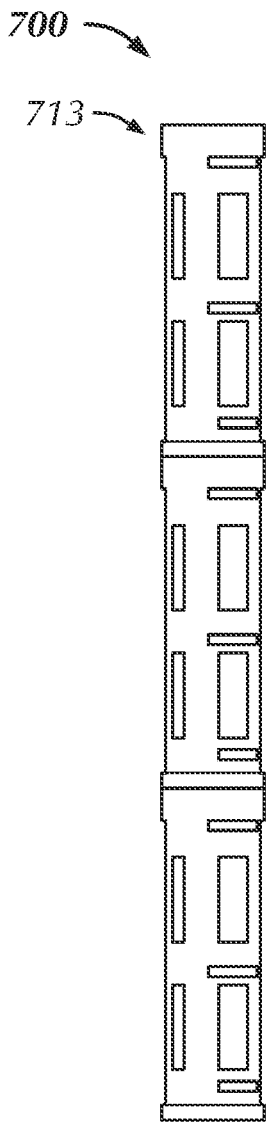
FIG. 7A, FIG. 7B, FIG. 7C, and FIG. 7D illustrate examples in accordance with one or more embodiments.
Figure 7B:
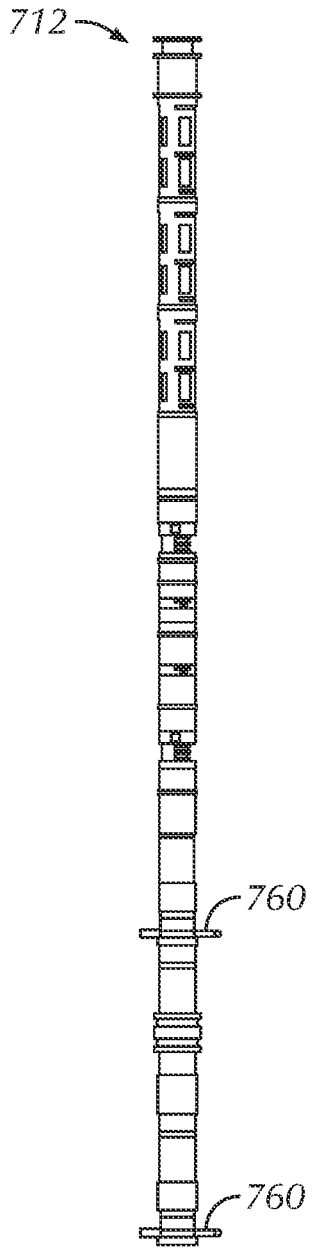
Figure 7C:
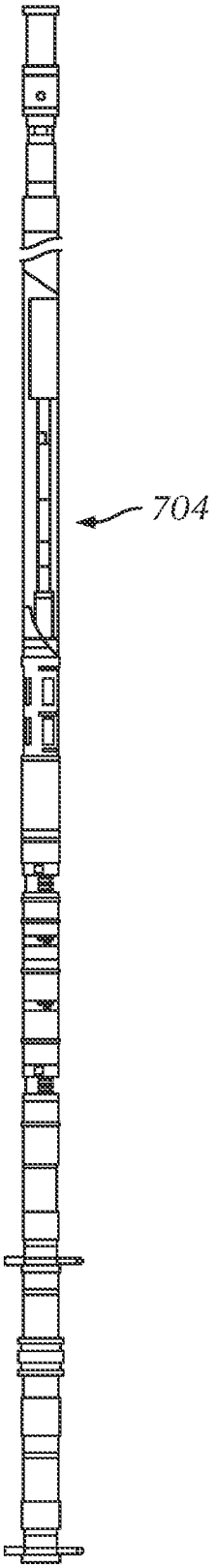
Figure 7D:
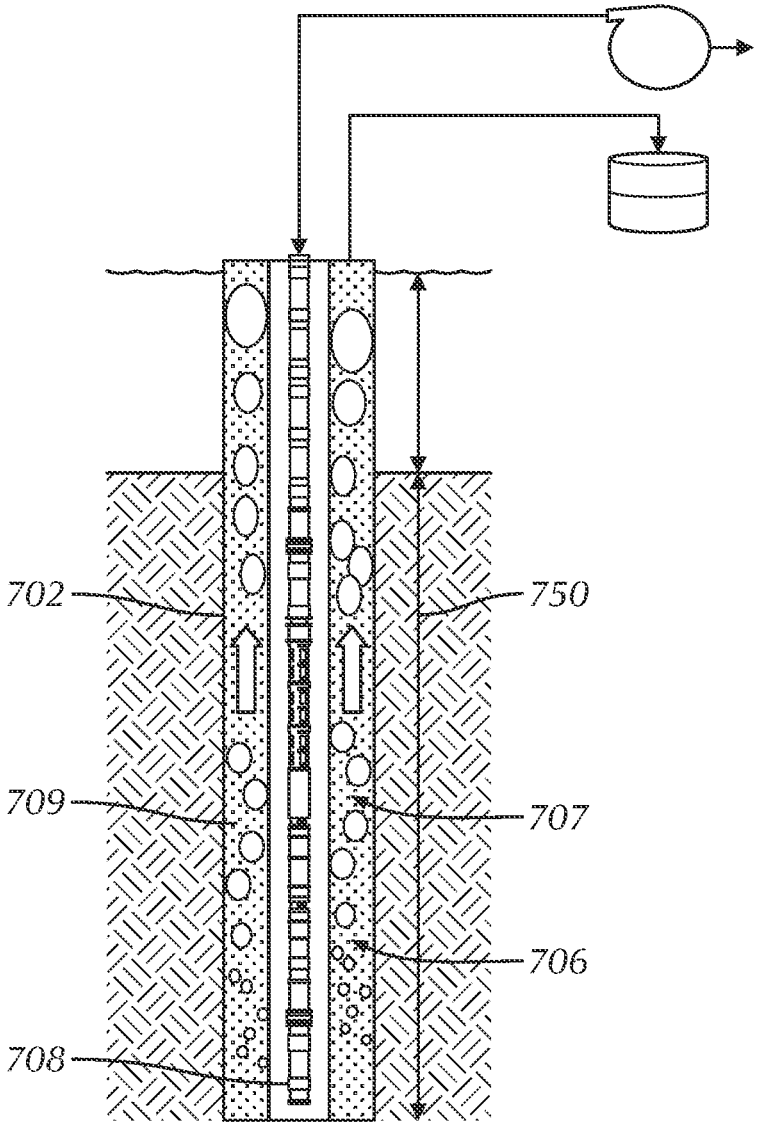

FIG. 7A, FIG. 7B, FIG. 7C, and FIG. 7D show an example system in accordance with one or more embodiments. FIGS. 7A-7D show various parts of the OHL-TS (e.g., OHLTS 700). FIG. 7A shows an example main part of formation sampling (e.g., logging tool 713) of an openhole logging string (e.g., openhole logging string 712). FIG. 7B shows the openhole logging string including example sensors (e.g., logging sensors 760). FIG. 7C shows the logging tool made up together with a wellbore fluids self-treating mechanism (e.g., jet anchor system 704). The logging tool is conveyed by drill pipe to the desired depth such as a hydrocarbon logging zone total length, a target depth, a designated depth, or a predetermined depth (e.g., determined depth 750). The logging string is deployed with the jet nozzle and the anchor. FIG. 7D shows the jetting nozzles (e.g., one or more of jet nozzle 708) in use and thereby generating a turbulent flow from the bottom of the wellbore in an uphole direction. The turbulent flow shears the wellbore fluids (e.g., wellbore fluids F 706), prevents the solids from settling down (e.g., solids fallback 707), and conditions the filter cake (e.g., filter cake 709) of the wellbore (e.g., wellbore 702). Using the OHLTS 700 may then maintain the wellbore with treated wellbore fluids without pulling out the logging string to run in hole with condition trips of bottom hole assemblies.

Figure 8:
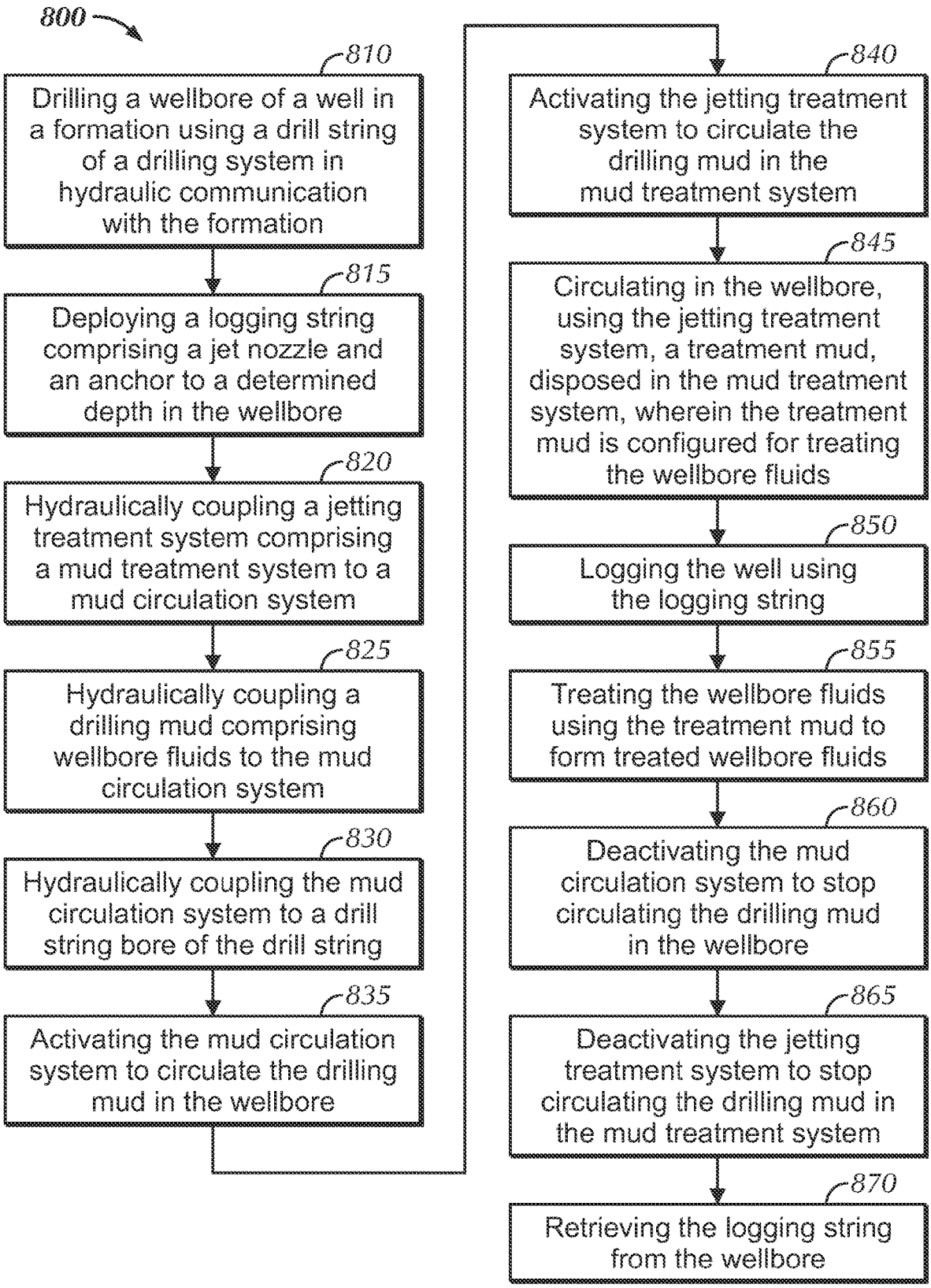
FIG. 8 illustrates a flowchart in accordance with one or more embodiments.

FIG. 8 shows a flowchart (e.g., flowchart 800) in accordance with one or more embodiments. FIG. 8 shows a flowchart of an example method for drilling a well. Specifically, FIG. 8 describes a general method using an openhole logging-treating system to drill a well. One or more blocks in FIG. 8 may be performed by one or more components, e.g., as described in FIGS. 1, 2, 3, 4, 5, 6A, 6B, 6C, 6D, 6E, 6F, 7A, 7B, 7C, 7D, and 9. While various blocks in FIG. 8 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At step 810, the method includes drilling a wellbore of a well in a formation using a drill string of a drilling system in hydraulic communication with the formation. Drilling the wellbore may include using a mud condition sensing system for monitoring a first mud condition of the drilling mud circulated by the mud circulation system. The drilling may include using a computer processor for comparing the first mud condition with a first predetermined criterion to form a first comparison. The drilling may include using the computer processor for determining a first result of the first comparison. The drilling may include using a control system for transmitting the activation signal to the jetting treatment system, based on the first result failing to satisfy the first predetermined criterion and activating the jetting treatment system in response to receipt of the activation signal.

Likewise, the drilling may include using the mud condition sensing system for monitoring a second mud condition of the drilling mud, using the computer processor for comparing the second mud condition with a second predetermined criterion to form a second comparison, then using the computer processor for determining a second result of the second comparison. The drilling may include using the control system for transmitting the deactivation signal to the jetting treatment system based on the second result satisfying the second predetermined criterion and deactivating the jetting treatment system in response to receipt of the deactivation signal.

The method may include maintaining the wellbore fluids using the treated wellbore fluids, the jetting treatment system, the mud treatment system, the mud circulation system, and the drilling mud. The formation may be an openhole formation and with a determined depth, which may be a wellbore depth to an openhole formation depth. The openhole formation may have a high overbalanced hydrostatic pressure against a formation pressure. Treating the wellbore fluids may include shearing the wellbore fluids, preventing a solids fallback, and conditioning a filter cake.

At step 815, the method includes deploying a logging string comprising a jet nozzle and an anchor to a determined depth in the wellbore. Deploying the logging string may include coupling the logging string to the wellbore.

At step 820, the method includes hydraulically coupling a jetting treatment system comprising a mud treatment system to a mud circulation system. The jetting treatment system may be activated upon receipt of an activation signal. In like manner, the jetting treatment system may be deactivated upon receipt of a deactivation signal.

At step 825, the method includes hydraulically coupling a drilling mud comprising wellbore fluids to the mud circulation system.

At step 830, the method includes hydraulically coupling the mud circulation system to a drill string bore of the drill string.

At step 835, the method includes activating the mud circulation system to circulate the drilling mud in the wellbore.

At step 840, the method includes activating the jetting treatment system to circulate the drilling mud in the mud treatment system. Activating the jetting treatment system may include using a jet-anchor of a jet anchor system for anchoring the logging string to the wellbore. The jet-anchor may include the jet nozzle and the anchor. The anchoring may include extending the jet-anchor from a logging tool outer surface to form a surface-surface contact between an anchor pad disposed on the anchor and the wellbore. The anchoring may include exposing the jet nozzle out from the logging tool outer surface for fluid communication from the drill string bore to the wellbore. The anchoring may include extending the jet nozzle out from an exterior surface of the anchor.

Activating the jetting treatment system may include pressuring a substance in the drill string to a first drillpipe pressure. The substance may be drilling mud, drilling fluid, wellbore fluid, water, diesel, etc. The activating of the jetting treatment system may include depressurizing the substance from the first drillpipe pressure to a second drillpipe pressure. The drillpipe pressure may be a pressure input to a mandrel driver.

Activating the jetting treatment system may include cycling a drillpipe pressure input to an indexer coupled to the logging string. The cycling may include a shifting of the indexer. The shifting of the indexer may include shifting from a first indexer setting to a second indexer setting in response to a first drillpipe pressure input, shifting from the second indexer setting to a third indexer setting in response to a second drillpipe pressure input, shifting from the third indexer setting to a fourth indexer setting in response to a third drillpipe pressure input, and shifting from the fourth indexer setting to the first indexer setting in response to a fourth drillpipe pressure input. The indexer may be configured as described with four indexer settings, or with six, eight, or any other practical value of indexer positions.

At step 845, the method includes circulating in the wellbore, using the jetting treatment system, a treatment mud, disposed in the mud treatment system, wherein the treatment mud is configured for treating the wellbore fluids.

At step 850, the method includes logging the well using the logging string. The method may include taking core samples using a core sampling system disposed in the logging string. Well logs may be obtained using a wellbore logging system disposed in the logging string. The wellbore logging system may produce a wellbore log. The logging string may include a logging tool such as a gamma ray logging tool and/or a nuclear magnetic resonance logging tool. These tools are used for generating well logs of the formation. Included in the log is a measurement of the depth as the tool traverses to the designated depth.

At step 855, the method includes treating the wellbore fluids using the treatment mud to form treated wellbore fluids. Treating the wellbore fluids may include using a lock mandrel and a mandrel driver for extending the anchor coupled to the logging string from a decoupled position to a coupled position. The coupled position may include a coupling of an anchor pad disposed on the anchor and the wellbore. Treating the wellbore fluids may include generating a turbulent flow at the designated depth using the jetting treatment system.

At step 860, the method includes deactivating the mud circulation system to stop circulating the drilling mud in the wellbore. Deactivating the mud circulation system may be in response to receipt of a deactivation command received by the mud circulation system and sent by a control system.

At step 865, the method includes deactivating the jetting treatment system to stop circulating the drilling mud in the mud treatment system. Deactivating the jetting treatment system may include pressuring the substance from the second drillpipe pressure to a third drillpipe pressure and depressurizing the substance from the third drillpipe pressure to a fourth drillpipe pressure. The drillpipe pressure may be a pressure input to a mandrel driver.

At step 870, the method includes retrieving the logging string from the wellbore. Retrieving the logging string may include decoupling the logging string from the wellbore.

Figure 9:
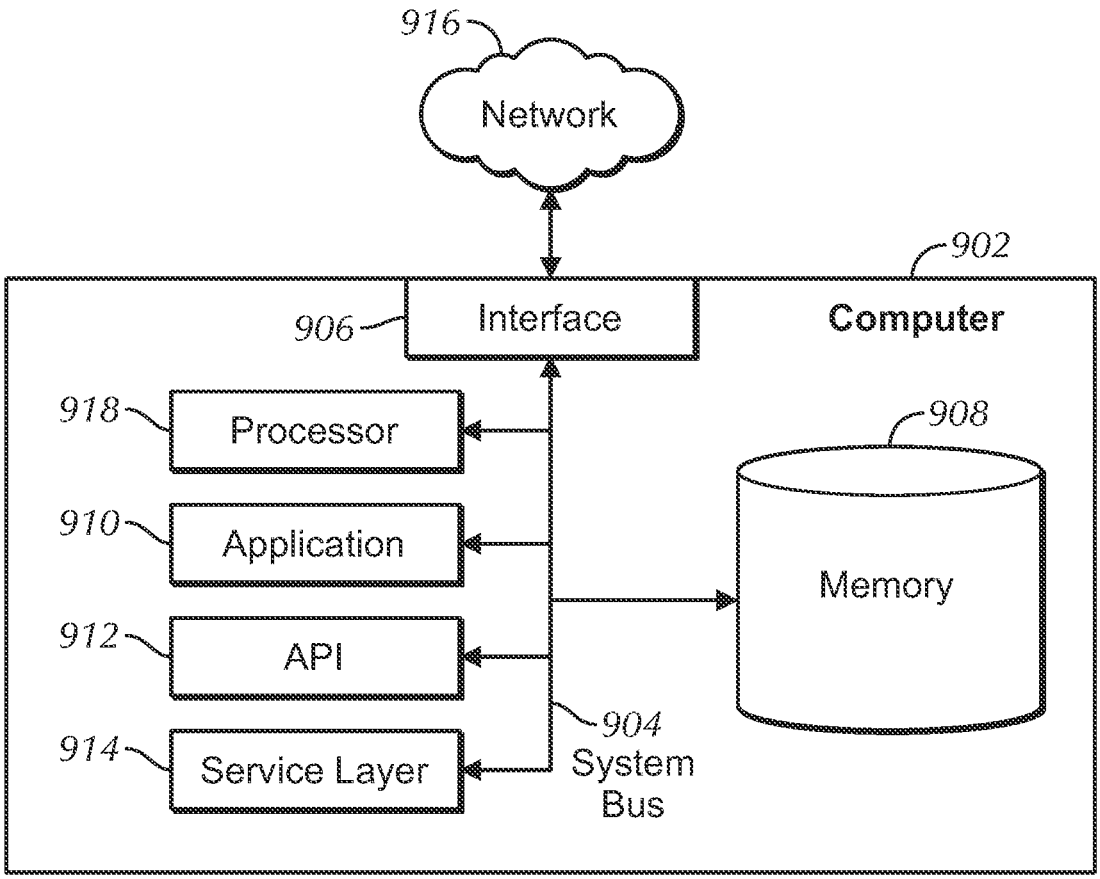
FIG. 9 illustrates a computer system in accordance with one or more embodiments.

Embodiments may be implemented on a computer system. FIG. 9 is a block diagram of a computer system such as the computer 902 used to provide computational functionalities associated with described algorithms, methods, functions, processes, flows, and procedures as described in the instant disclosure, according to an implementation. The illustrated computer (e.g., computer 902) is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 902 may include a computer that includes an input device, such as a keypad, keyboard, touch screen, or other device that can accept user information, and an output device that conveys information associated with the operation of the computer 902, including digital data, visual, or audio information (or a combination of information), or a graphical user interface.

The computer 902 can serve in a role as a client, network component, a server, a database or other persistency, or any other component (or a combination of roles) of a computer system for performing the subject matter described in the instant disclosure. The illustrated computer (computer 902) is communicably coupled with a network 916. In some implementations, one or more components of the computer 902 may be configured to operate within environments, including cloud-computing-based, local, global, or other environment (or a combination of environments).

At a high level, the computer 902 is an electronic computing device operable to receive, transmit, process, store, or manage data and information associated with the described subject matter. According to some implementations, the computer 902 may also include or be communicably coupled with an application server, e-mail server, web server, caching server, streaming data server, business intelligence server, or other server (or a combination of servers).

The computer 902 can receive requests over network 916 from a client application (for example, executing on another computer 902) and responding to the received requests by processing the said requests in an appropriate software application. In addition, requests may also be sent to the computer 902 from internal users (for example, from a command console or by other appropriate access method), external or third-parties, other automated applications, as well as any other appropriate entities, individuals, systems, or computers.

Each of the components of the computer 902 can communicate using a system bus 904. In some implementations, any or all of the components of the computer 902, both hardware or software (or a combination of hardware and software), may interface with each other or the interface 906 (or a combination of both) over the system bus 904 using an application programming interface (an API 912) or a service layer 914 (or a combination of the API 912 and service layer 914. The API 912 may include specifications for routines, data structures, and object classes. The API 912 may be either computer-language independent or dependent and refer to a complete interface, a single function, or even a set of APIs. The service layer 914 provides software services to the computer 902 or other components (whether or not illustrated) that are communicably coupled to the computer 902. The functionality of the computer 902 may be accessible for all service consumers using this service layer. Software services, such as those provided by the service layer 914, provide reusable, defined business functionalities through a defined interface. For example, the interface may be software written in JAVA, C++, or other suitable language providing data in extensible markup language (XML) format or other suitable format. While illustrated as an integrated component of the computer 902, alternative implementations may illustrate the API 912 or the service layer 914 as stand-alone components in relation to other components of the computer 902 or other components (whether or not illustrated) that are communicably coupled to the computer 902. Moreover, any or all parts of the API 912 or the service layer 914 may be implemented as child or sub-modules of another software module, enterprise application, or hardware module without departing from the scope of this disclosure.

The computer 902 includes an interface 906. Although illustrated as a single interface in FIG. 9, two or more of the interfaces may be used according to particular needs, desires, or particular implementations of the computer 902. The interface 906 is used by the computer 902 for communicating with other systems in a distributed environment that are connected to the network 916. Generally, the interface 906 includes logic encoded in software or hardware (or a combination of software and hardware) and operable to communicate with the network 916. More specifically, the interface 906 may include software supporting one or more communication protocols associated with communications such that the network 916 or hardware of the interface is operable to communicate physical signals within and outside of the illustrated computer (computer 902).

The computer 902 includes at least one of a computer processor 918. Although illustrated as a single computer processor in FIG. 9, two or more processors may be used according to particular needs, desires, or particular implementations of the computer 902. Generally, the computer processor 918 executes instructions and manipulates data to perform the operations of the computer 902 and any algorithms, methods, functions, processes, flows, and procedures as described in the instant disclosure.

The computer 902 also includes a memory 908 that holds data for the computer 902 or other components (or a combination of both) that can be connected to the network 916. For example, memory 908 can be a database storing data consistent with this disclosure. Although illustrated as a single memory in FIG. 9, two or more memories may be used according to particular needs, desires, or particular implementations of the computer 902 and the described functionality. While memory 908 is illustrated as an integral component of the computer 902, in alternative implementations, memory 908 can be external to the computer 902.

The application 910 is an algorithmic software engine providing functionality according to particular needs, desires, or particular implementations of the computer 902, particularly with respect to functionality described in this disclosure. For example, application 910 can serve as one or more components, modules, applications, etc. Further, although illustrated as a single one of application 910, the application 910 may be implemented as a multiple quantity of application 910 on the computer 902. In addition, although illustrated as integral to the computer 902, in alternative implementations, the application 910 can be external to the computer 902.

There may be any number of computers such as the computer 902 associated with, or external to, a computer system containing computer 902, each computer 902 communicating over network 916. Further, the term "client," "user," and other appropriate terminology may be used interchangeably as appropriate without departing from the scope of this disclosure. Moreover, this disclosure contemplates that many users may use one of computer 902, or that one user may use multiple computers such as computer 902.

In some embodiments, the computer 902 is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method comprising:

drilling a wellbore of a well in a formation using a drill string of a drilling system in hydraulic communication with the formation;

deploying a logging string configured to hydraulically couple to the drilling system using the drill string and comprising a jet nozzle and an anchor to a determined depth in the wellbore;

hydraulically coupling a jetting treatment system comprising a mud treatment system to a mud circulation system;

hydraulically coupling a drilling mud comprising wellbore fluids to the mud circulation system;

hydraulically coupling the mud circulation system to a drill string bore of the drill string;

activating the mud circulation system to circulate the drilling mud in the wellbore;

activating the jetting treatment system to circulate the drilling mud in the mud treatment system;

circulating in the wellbore, using the jetting treatment system, a treatment mud, disposed in the mud treatment system, wherein the treatment mud is configured for treating the wellbore fluids;

logging the well using the logging string;

treating the wellbore fluids using the treatment mud to form treated wellbore fluids;

deactivating the mud circulation system to stop circulating the drilling mud in the wellbore;

deactivating the jetting treatment system to stop circulating the drilling mud in the mud treatment system; and retrieving the logging string from the wellbore.

2. The method of claim 1, wherein the jetting treatment system is configured for:

activating upon receipt of an activation signal; and deactivating upon receipt of a deactivation signal;

wherein drilling the wellbore further comprises:

monitoring, using a mud condition sensing system, a first mud condition of the drilling mud circulated by the mud circulation system;

comparing, using a computer processor, the first mud condition with a first predetermined criterion to form a first comparison;

determining, using the computer processor, a first result of the first comparison;

transmitting, using a control system, the activation signal to the jetting treatment system, based on the first result failing to satisfy the first predetermined criterion;

activating the jetting treatment system in response to receipt of the activation signal;

monitoring, using the mud condition sensing system, a second mud condition of the drilling mud;

comparing, using the computer processor, the second mud condition with a second predetermined criterion to form a second comparison;

determining, using the computer processor, a second result of the second comparison;

transmitting, using the control system, the deactivation signal to the jetting treatment system, based on the second result satisfying the second predetermined criterion; and deactivating the jetting treatment system in response to receipt of the deactivation signal.

3. The method of claim 1, wherein deploying the logging string comprises coupling the logging string to the wellbore; and retrieving the logging string comprises decoupling the logging string from the wellbore.

4. The method of claim 1, wherein activating the jetting treatment system comprises:

anchoring, using a jet anchor system comprising a jet-anchor, the logging string to the wellbore; and wherein the jet-anchor comprises the jet nozzle and the anchor;

wherein anchoring comprises:

extending the jet-anchor from a logging tool outer surface to form a surface-surface contact between an anchor pad disposed on the anchor and the wellbore, and exposing the jet nozzle out from the logging tool outer surface for fluid communication from the drill string bore to the wellbore.

5. The method of claim 1, wherein treating the wellbore fluids comprises extending, using a lock mandrel and a mandrel driver, the anchor coupled to the logging string from a decoupled position to a coupled position; wherein the coupled position comprises a coupling of an anchor pad, disposed on the anchor, and the wellbore.

6. The method of claim 1, wherein activating the jetting treatment system comprises:

pressuring a substance in the drill string to a first drillpipe pressure; and depressurizing the substance from the first drillpipe pressure to a second drillpipe pressure, wherein deactivating the jetting treatment system comprises:

pressuring the substance from the second drillpipe pressure to a third drillpipe pressure; and depressurizing the substance from the third drillpipe pressure to a fourth drillpipe pressure.

7. The method of claim 1, wherein activating the jetting treatment system comprises:

cycling a drillpipe pressure input to an indexer coupled to the logging string;

wherein cycling comprises a shifting of the indexer;

wherein the shifting of the indexer comprises:

shifting from a first indexer setting to a second indexer setting in response to a first drillpipe pressure input, shifting from the second indexer setting to a third indexer setting in response to a second drillpipe pressure input, shifting from the third indexer setting to a fourth indexer setting in response to a third drillpipe pressure input, and shifting from the fourth indexer setting to the first indexer setting in response to a fourth drillpipe pressure input.

8. The method of claim 1, wherein treating the wellbore fluids comprises generating a turbulent flow at the determined depth using the jetting treatment system.

9. The method of claim 1, further comprising:

maintaining the wellbore fluids using the treated wellbore fluids, the jetting treatment system, the mud treatment system, the mud circulation system, and the drilling mud.

10. The method of claim 1, wherein the formation comprises an openhole formation;

wherein the determined depth comprises a wellbore depth to an openhole formation depth; and wherein the openhole formation comprises a high overbalanced hydrostatic pressure against a formation pressure;

wherein treating the wellbore fluids further comprises;

shearing the wellbore fluids, preventing a solids fallback, and conditioning a filter cake.

11. A system comprising:

a drill string of a drilling system in hydraulic communication with a formation configured for drilling a wellbore of a well in the formation;

a logging string comprising a jet nozzle and an anchor configured for deploying to a determined depth in the wellbore and hydraulically couple to the drilling system using the drill string;

a jetting treatment system comprising a mud treatment system configured for hydraulically coupling to a mud circulation system;

a drilling mud comprising wellbore fluids configured for hydraulically coupling to the mud circulation system;

wherein the mud circulation system is configured for hydraulically coupling to a drill string bore of the drill string;

wherein the mud circulation system, when activated, is configured to circulate the drilling mud in the wellbore;

wherein the jetting treatment system, when activated, is configured to circulate the drilling mud in the mud treatment system; and a treatment mud disposed in the mud treatment system configured for:

treating the wellbore fluids; and circulating, using the jetting treatment system, in the wellbore;

wherein the logging string is configured for logging the well;

wherein treated wellbore fluids are formed from treating the wellbore fluids using the treatment mud;

wherein the mud circulation system, when deactivated, is configured to stop circulating the drilling mud in the wellbore; and wherein the jetting treatment system, when deactivated, is configured to stop circulating the drilling mud in the mud treatment system;

wherein the logging string is configured to be retrieved from the wellbore.

12. The system of claim 11, wherein the jetting treatment system is configured for:

activating upon receipt of an activation signal; and deactivating upon receipt of a deactivation signal; and the system further comprising:

a mud condition sensing system configured for monitoring a first mud condition of the drilling mud circulated by the mud circulation system;

a computer processor configured for comparing the first mud condition with a first predetermined criterion to form a first comparison;

wherein the computer processor is configured to determine a first result of the first comparison;

a control system configured for transmitting the activation signal to the jetting treatment system, based on the first result failing to satisfy the first predetermined criterion;

wherein the jetting treatment system is configured for activating in response to receipt of the activation signal;

wherein the mud condition sensing system is configured for monitoring a second mud condition of the drilling mud;

wherein the computer processor is configured for:

comparing the second mud condition with a second predetermined criterion to form a second comparison; and determining a second result of the second comparison; and wherein the control system is configured for transmitting the deactivation signal to the jetting treatment system based on the second result satisfying the second predetermined criterion;

wherein the jetting treatment system is configured for deactivating in response to receipt of the deactivation signal.

13. The system of claim 11, wherein the logging string is configured for:

coupling to the wellbore for deploying the logging string; and decoupling from the wellbore for retrieving the logging string.

14. The system of claim 11, wherein the logging string comprises a jet anchor system comprising a jet-anchor configured for anchoring the logging string to the wellbore;

wherein the jet-anchor comprises the jet nozzle and the anchor; and wherein anchoring comprises:

extending the jet-anchor from a logging tool outer surface to form a surface-surface contact between an anchor pad disposed on the anchor and the wellbore, and exposing the jet nozzle out from the logging tool outer surface for fluid communication from the drill string bore to the wellbore.

15. The system of claim 11, further comprising:

a lock mandrel and a mandrel driver configured for extending the anchor, coupled to the logging string, from a decoupled position to a coupled position; wherein the coupled position comprises a coupling between an anchor pad, disposed on the anchor, and the wellbore.

16. The system of claim 11, further comprising:

a substance in the drill string configured for:

activating the jetting treatment system by pressurizing from a first drillpipe pressure to a second drillpipe pressure, and deactivating the jetting treatment system by:

pressurizing from the second drillpipe pressure to a third drillpipe pressure; and depressurizing from the third drillpipe pressure to a fourth drillpipe pressure.

17. The system of claim 11 further comprising:

an indexer coupled to the logging string, configured for cycling of a drillpipe pressure input to the indexer, wherein cycling comprises a shifting of the indexer;

wherein the shifting of the indexer comprises:

shifting from a first indexer setting to a second indexer setting in response to a first drillpipe pressure input, shifting from the second indexer setting to a third indexer setting in response to a second drillpipe pressure input, shifting from the third indexer setting to a fourth indexer setting in response to a third drillpipe pressure input, and shifting from the fourth indexer setting to the first indexer setting in response to a fourth drillpipe pressure input.

18. The system of claim 11, further comprising:

a turbulent flow, generated at the determined depth using the jetting treatment system, for treating the wellbore fluids.

19. The system of claim 11, wherein the system is configured to maintain the wellbore fluids using the treated wellbore fluids, the jetting treatment system, the mud treatment system, the mud circulation system, and the drilling mud.

20. The system of claim 11, wherein the formation comprises an openhole formation;

wherein the determined depth comprises a wellbore depth to an openhole formation depth;

wherein the openhole formation comprises a high overbalanced hydrostatic pressure against a formation pressure; and wherein treating the wellbore fluids further comprises;

shearing the wellbore fluids, preventing a solids fallback, and conditioning a filter cake.

* * * * *